US011002009B2

(12) United States Patent
Claeys et al.

(10) Patent No.: US 11,002,009 B2
(45) Date of Patent: May 11, 2021

(54) WALL ELEMENT FOR A CURTAIN WALL WITH A COMPARTMENT FOR A WING AND A SEALING ELEMENT

(71) Applicants: Stephanie Catharina R. Claeys, Zandhoven (BE); Laurens Leonard J. Claeys, Zandhoven (BE); Nausikaa Els P. Claeys, Zandhoven (BE)

(72) Inventors: Stephanie Catharina R. Claeys, Zandhoven (BE); Laurens Leonard J. Claeys, Zandhoven (BE); Nausikaa Els P. Claeys, Zandhoven (BE)

(73) Assignees: Stephanie Catharina R. Claeys, Zandhoven (BE); Laurens Leonard J. Claeys, Zandhoven (BE); Nausikaa Els P. Claeys, Zandhoven (BE)

( * ) Notice: Subject to any disclaimer, the term of this patent is extended or adjusted under 35 U.S.C. 154(b) by 0 days.

(21) Appl. No.: 16/337,607

(22) PCT Filed: Oct. 20, 2017

(86) PCT No.: PCT/IB2017/056533
§ 371 (c)(1),
(2) Date: Mar. 28, 2019

(87) PCT Pub. No.: WO2018/073801
PCT Pub. Date: Apr. 26, 2018

(65) Prior Publication Data

US 2020/0032510 A1 Jan. 30, 2020

(30) Foreign Application Priority Data

Oct. 21, 2016 (BE) ..... 2016/5794
Oct. 27, 2016 (BE) ..... 2016/5810

(51) Int. Cl.
*E04B 2/96* (2006.01)
*E06B 3/54* (2006.01)
*E06B 3/67* (2006.01)

(52) U.S. Cl.
CPC ..... *E04B 2/967* (2013.01); *E04B 2/965* (2013.01); *E06B 3/5427* (2013.01); *E06B 3/6715* (2013.01)

(58) Field of Classification Search
CPC ... E04B 2/96; E04B 2/88; E04B 2/965; E04B 2/967
(Continued)

(56) References Cited

U.S. PATENT DOCUMENTS 5,893,244 A * 4/1999 Magoon ..... E04B 2/965 52/235
6,158,182 A * 12/2000 Biebuyck ..... E04B 2/96 52/204.53
(Continued)

FOREIGN PATENT DOCUMENTS

DE 10200449 A1 7/2003
DE 10223038 A1 12/2003
(Continued)

OTHER PUBLICATIONS

International Search Report in related PCT/IB2017/056533, dated Feb. 23, 2018.
(Continued)

*Primary Examiner* — Brian E Glessner
*Assistant Examiner* — Adam G Barlow
(74) *Attorney, Agent, or Firm* — Bacon & Thomas, PLLC

(57) ABSTRACT

A sealing to seal a wall element with a fixed frame having mullions and transoms with perpendicular ends with which the transoms are attached between the mullions. The fixed frame is fitted with at least one compartment with a rebate
(Continued)

for a frame part with an infill element to create a wing that opens, or to replace a damaged infill element, where the seal is intended to create a windproof and watertight connection between the mullions and transoms in the corners of an aforementioned compartment, where the seal is made as a corner piece that is formed and sized such that, on the level of the corners to be sealed, it fits in the form of the rebate in the mullion and transom in question and overlaps and covers the connection between this mullion and transom at the level of the rebate.

13 Claims, 25 Drawing Sheets

(58) Field of Classification Search
USPC ..... 52/208, 235, 284, 395, 463, 464, 466, 52/467, 468, 476, 506.06, 772
See application file for complete search history.

(56) References Cited

U.S. PATENT DOCUMENTS

| | | | | |
|---|---|---|---|---|
| 8,011,146 | B2 * | 9/2011 | Krause | F41H 5/263 52/235 |
| 8,453,402 | B2 * | 6/2013 | Huang | E04B 2/96 52/235 |
| 10,400,445 | B2 * | 9/2019 | Battaglia | E04B 2/967 |
| 2004/0031220 | A1 * | 2/2004 | Hocker | E04B 2/965 52/235 |
| 2011/0258945 | A1 * | 10/2011 | Arbour | E04B 2/88 52/173.3 |
| 2012/0210664 | A1 | 8/2012 | Lang et al. | |
| 2014/0026502 | A1 * | 1/2014 | Carbary | E06B 3/5427 52/235 |
| 2015/0284950 | A1 | 10/2015 | Stramandinoli | |
| 2015/0284951 | A1 * | 10/2015 | Frederick | E04B 2/90 52/235 |
| 2016/0053487 | A1 * | 2/2016 | Frederick | E04B 2/96 52/235 |
| 2018/0216344 | A1 * | 8/2018 | Battaglia | E04B 1/8209 |

FOREIGN PATENT DOCUMENTS

| | | | | |
|---|---|---|---|---|
| EP | 0645504 | A2 | 8/1994 | |
| EP | 0641902 | A1 * | 3/1995 | E04B 2/962 |
| EP | 0641902 | A1 | 3/1995 | |
| EP | 1223257 | A1 | 7/2002 | |
| EP | 1437449 | A3 | 4/2005 | |

OTHER PUBLICATIONS

Written Opinion in related PCT/IB2017/056533, dated Feb. 23, 2018.
Belgium Search Report in related Belgium Application No. 201605810, dated May 16, 2017.
Chinese Office Action in corresponding Chinese Application No. 201780065106.1, dated Jun. 10, 2020.
Eurasian Office Action in corresponding Eurasian Application No. 201990962(31), dated Apr. 17, 2020.
Chinese Office Action and Search Report in corresponding Chinese Application No. 201780065106.1, dated Jun. 10, 2020.

* cited by examiner

WALL ELEMENT FOR A CURTAIN WALL WITH A COMPARTMENT FOR A WING AND A SEALING ELEMENT

The current invention relates to a sealing for a wall element of a curtain wall, more specifically for a wall element of the modular type with a two-part frame, e.g. with a fixed frame part and a frame part of a wing of a window hingeably applied therein.

BACKGROUND OF THE INVENTION

The EP 0.641.902 describes a type of curtain wall known from the stick principle, also referred to as mullion-transom system, which is an entirely different system than a curtain wall of the frame type as referred to in the current invention.

Such a curtain wall comprises a supporting structure of mullions and transoms which define rectangular compartments that are filled with infill elements made of glass or the like. In this case the infill elements are clamped along the edges with seals on the mullions and transoms using a cover profile. These seals make the wall waterproof and windtight.

This EP 0.641.902 also shows a compartment with a window that opens consisting of a fixed frame attached to the mullions with a rebate for the frame of a wing that opens with an infill element which along its edges sits in this frame that opens.

In this system a sealing is realised by means of a vulcanisation of a sealing rubber as has been the case for all rubbers for years.

US 2012/0210664 relates to yet another type of curtain wall in which the ends of the transoms are worked to fit in the profile of the mullions and an opening is made in which a plug is fitted, whereby the connection between the mullions and transoms using a plug is completely filled with silicones, which must be avoided due to its non-durability and the tearing of the silicones, with the knowledge that a curtain wall moves due to wind and thermal effects.

Moreover, it is known that silicones can only efficiently make a seal between two parallel surfaces, which is not the case in US 2012/0210664.

US 2012/0210664 therefore again concerns a completely different system than this of a curtain wall of the frame type as referred to in the invention. The corners of this well-known system of the US 2012/0210664 are completely sealed with silicones, which is prohibited as this cannot possibly result in the required sealing.

Moreover, in this system the silicones are applied on site in usually unfavourable circumstances whereby you are confronted with wet or dirty profiles resulting in the silicones not sealing at all anymore.

This system of sealing is exactly what is not allowed and describes a worthless connection the problems of which are adequately known on the market.

SUMMARY OF THE INVENTION

However, the invention relates to another type of curtain wall, more specifically curtain walls of the modular type constructed from mostly rectangular prefabricated wall elements which are connected to each other sideways with seals in horizontal rows extending one above the other.

The basic structure of such a unitized curtain wall is formed by the structural profiles of the unitized curtain wall which are assembled to form a whole, the so-called modules or frames.

Such a wall element de facto spans at least one storey height, sometimes also two to sometimes even three storeys, otherwise the wall element cannot be attached to the structure of the building.

This implies that over the height of such a wall element various empty compartments need to be filled.

For this "filling" there are three options, more specifically:

a fixed see-through glazing;

or a fixed blind panel;

or a wing that opens of a door or a window.

A frame for a window that opens thus normally consists of a fixed basic frame and a wing that opens which "hangs" in the fixed basic frame with window hardware.

A wing that opens de facto implies rubbers over the whole perimeter of the wing which can never be 100% windproof and watertight.

This means that in the "chamber" or so-called rebate, created between the wing and the basic frame, moisture or water can de facto enter which in itself is not so bad if two conditions have been met, more specifically that the infiltration water:

can be drained outside along openings;

cannot enter inside via mitres and other "connections" such as inside rubbers.

In all traditional systems the supporting basic structure is formed by mullions and transoms and a separate so-called external frame is always needed, both for the assembly of fixed infill elements and to flush mount a wing frame, the separate external frames then being attached to the basic structure, typically with screws.

The immediate result for such a separate external frame for a wing that opens is that this extra frame and wing are well visible and in this way strongly differ in terms of look on the inside compared to modules with fixed infill elements.

The construction of a double frame obviously involves an extra cost.

The sealing between the external frame and the wing frame often also causes problems.

In these traditional systems the frames are put together with hollow profiles which in the corners are mitred using L-shaped corner pieces which are slid in the hollow profiles with their legs and glued in.

This connection technique of the profiles is cumbersome, requires accuracy and many man hours.

However, the current invention concerns another type of wall element, more specifically a modular wall element of a unitized curtain wall with a basic frame with at least one compartment with a wing that opens, whereby the basic frame is fitted with a rebate for the wing that opens which consists of a wing frame with an infill element which from the outside covers the wing frame and that, e.g., is attached to the wing frame using structural glue.

An advantage of such a wall element according to the invention is that this wall element cannot be visually distinguished from the other wall elements with fixed infill elements on fixed frames, neither from the outside nor the inside of the curtain wall.

Another advantage is that this wall element does not contain an extra external frame around the wing, thus eliminating the cost.

The invention more specifically relates to a wall element for a curtain wall of the modular frame type in that the wall element contains a basic frame made of mullions and transoms that contain one or more compartments of which at least one compartment is fitted with a rebate to flush-mount a wing, whereby the transoms of such compartment for a wing have perpendicular ends and are attached with these ends between the mullions, whereby the mullions are made of profiles with an internal chamber contained by an outer wall and a sidewall of the mullion which, to form the rebate in the compartment in question, are at least partially locally removed along the height of the compartment, and whereby in the corners of the compartment for a wing a sealing has been fitted to create a windtight and waterproof connection between the mullions and transoms of an aforementioned compartment, whereby the sealing is made as a corner piece from rubber or another flexible sealing material and that is formed and sized so that it fits at the level of the corners to be sealed in the form of the rebate in the mullion and transom in question and as such overlaps and covers the connection between this mullion and transom at the level of the rebate.

In this way the sealing of the corner connections between the mullions and transoms of a compartment with a rebate is easy to achieve by putting in and attaching the aforementioned corner pieces in the corners.

These corner pieces can simply be slid on the ends of the transoms during the assembly of the basic frames in the factory, after which these transoms can be attached with the corner pieces between the mullions, e.g. using screws.

By milling open the internal chamber of the mullions of the basic frame to make a rebate, no separate external frame is required anymore as the basic frame serves as the so-called external frame as it were.

Preferably the design of the corner piece allows it to grip in the corners over the remaining part of the connecting walls of the mullions above and under the rebate.

To this end, the corner piece has, for instance, a U-shaped profiled body with a back and legs with which the corner piece grips against the wall of the rebate of a transom.

Additionally, the side edge of the corner piece can have a U-shaped finish because, for instance, the aforementioned legs of the corner piece are extended with a part that sticks out vis-a-vis the edge of the back of the corner piece, whereby the corner piece grips over the remaining part of the connecting wall of the opened side chamber of an adjacent mullion with these extended parts.

At the level of the connecting walls the used profiles can have overlying detailing which at the level of the corners can be partially removed over a certain length so that when tightening the transom against an adjacent mullion, the corner piece is clamped between the remaining part of the overlying detailing and the adjacent mullion.

The corner pieces can be glued optionally.

Preferably the corner piece has been sealed in the rebate without the use of silicones or other sealing material.

The advantages of the invention can be summarised as follows:

- no separate extra external frame is needed;
- the so-called "external frame" is realised by the profiles of the basic frame itself;
- the profiles of the mullions and transoms of the basic frame are designed to operate in the best possible way, whereby no account has to be taken of how and in what way to realise the connection of a mullion and transom in a perfectly windproof and watertight manner;
- indeed, the required wind and waterproof connection between the mullions and transom in a compartment for a wing is achieved using a plastic instrument placed on the inside of a perpendicular corner connection, and which is therefore visible when the wing is opened, which causes no problem, such that a perfectly sealed connection is achieved without the use of any silicone or such material and whereby this connection is such that in the event of any distortion in the rectangular window opening, under whatever influence or for whatever reason, this connection will still always remain perfectly sealed due to the fact that it is not a rigid connection, but instead achieved using a semi-supple corner piece; this corner piece is applied in the factory and therefore under perfect quality control.

The invention also relates to a sealing in the form of a corner piece intended to create a watertight connection between the transom and the mullion of a basic frame in the wall compartments with a wing that opens.

BRIEF DESCRIPTION OF THE DRAWINGS

With the intention of better showing the characteristics of the invention, a preferred embodiment of a modular curtain wall and wall elements and corner pieces for sealing according to the invention applied therein, is described hereinafter, by way of an example without any limiting nature, with reference to the accompanying drawings wherein:

FIGS. 11 to 14 show cross-sections according to the lines XI-XI to XIV-XIV in FIG. 10, however in FIGS. 11 and 14 with a wing that opens;

DETAILED DESCRIPTION OF INVENTION

Figure 1:
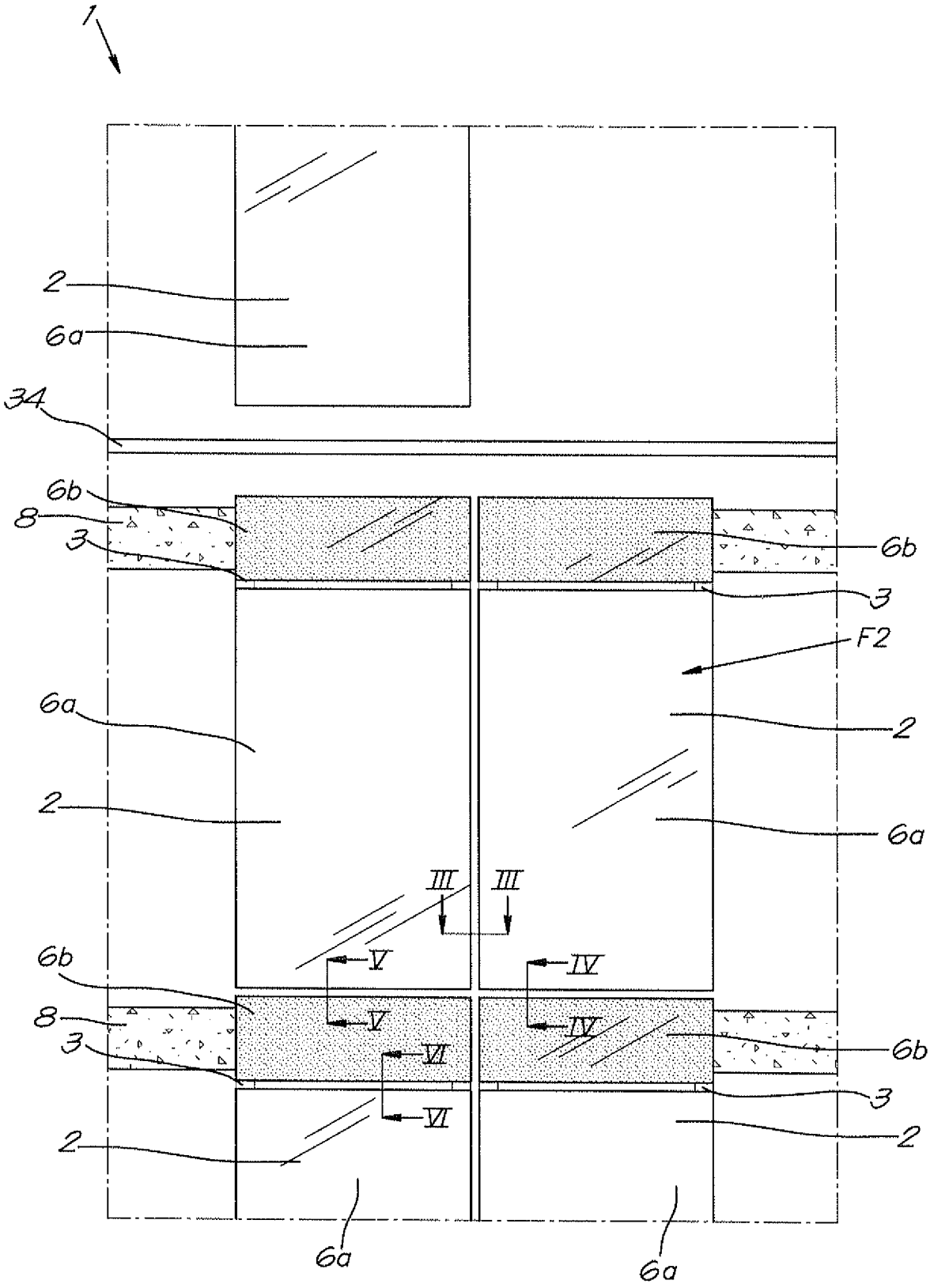
FIG. 1 schematically shows an external view of a curtain wall according to the invention being constructed with a partial cutaway.

The curtain wall 1 shown in FIG. 1 is a curtain wall of the modular type constructed from individual prefabricated rectangular wall elements 2 in the form of separate modules placed in rows next to and above one another to create a level wall, forming the supporting structure of the curtain wall 1.

Figure 2:
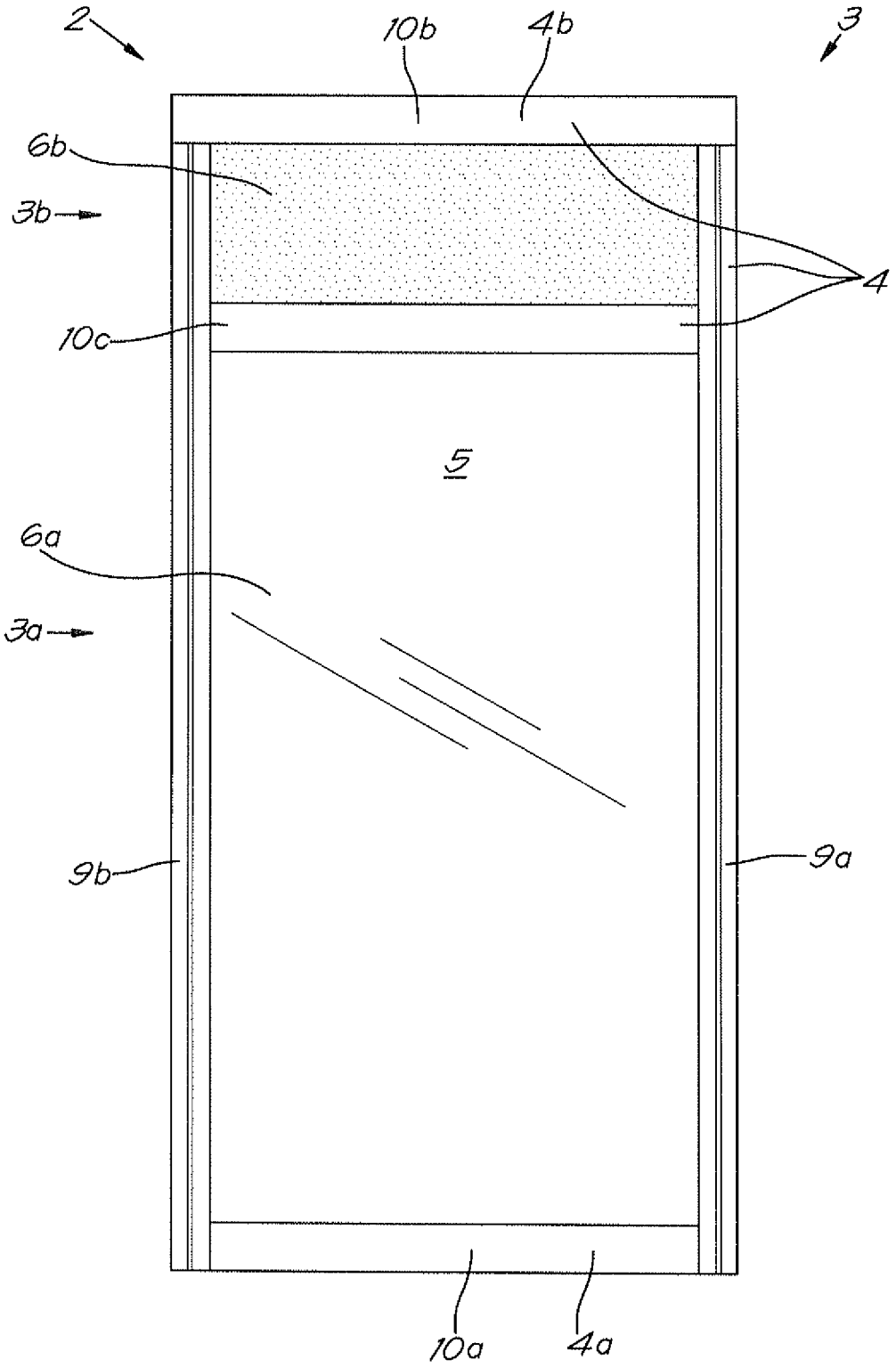
FIG. 2 shows an internal view of a wall element as indicated with F2 in FIG. 1.

As is apparent in FIG. 2 the wall elements 2 or modules are composed of a basic frame 3 of assembled one-piece profiles 4 on the inside 5 of the curtain wall 1 and of rectangular infill elements 6 on the outside 7 of the curtain wall 1 which almost entirely cover the basic frame 3, whereby the basic frame 3 is therefore hidden behind the infill elements 6 so that it appears as if the outside 7 of the curtain wall 1 consists entirely of infill elements in glass or the like.

The wall elements 2 are suspended on a basic structure at floor height 8, whereby a wall element 2 spans the height of a storey.

Preferably, the wall elements 2 are fitted with two infill elements, being a see-through infill element 6*a* at floor level and preferably a non-translucent or opaque infill element 6*b* to conceal the thickness of the floors 8.

In the example in the figures the infill elements 6 are formed by triple glazing although this is not essential.

Frame 3 is constructed from one-piece mullions 9 and one-piece transoms 10, whereby the transoms 10 have perpendicular ends and are connected with the mullions 9 using screws 11.

Figure 3:
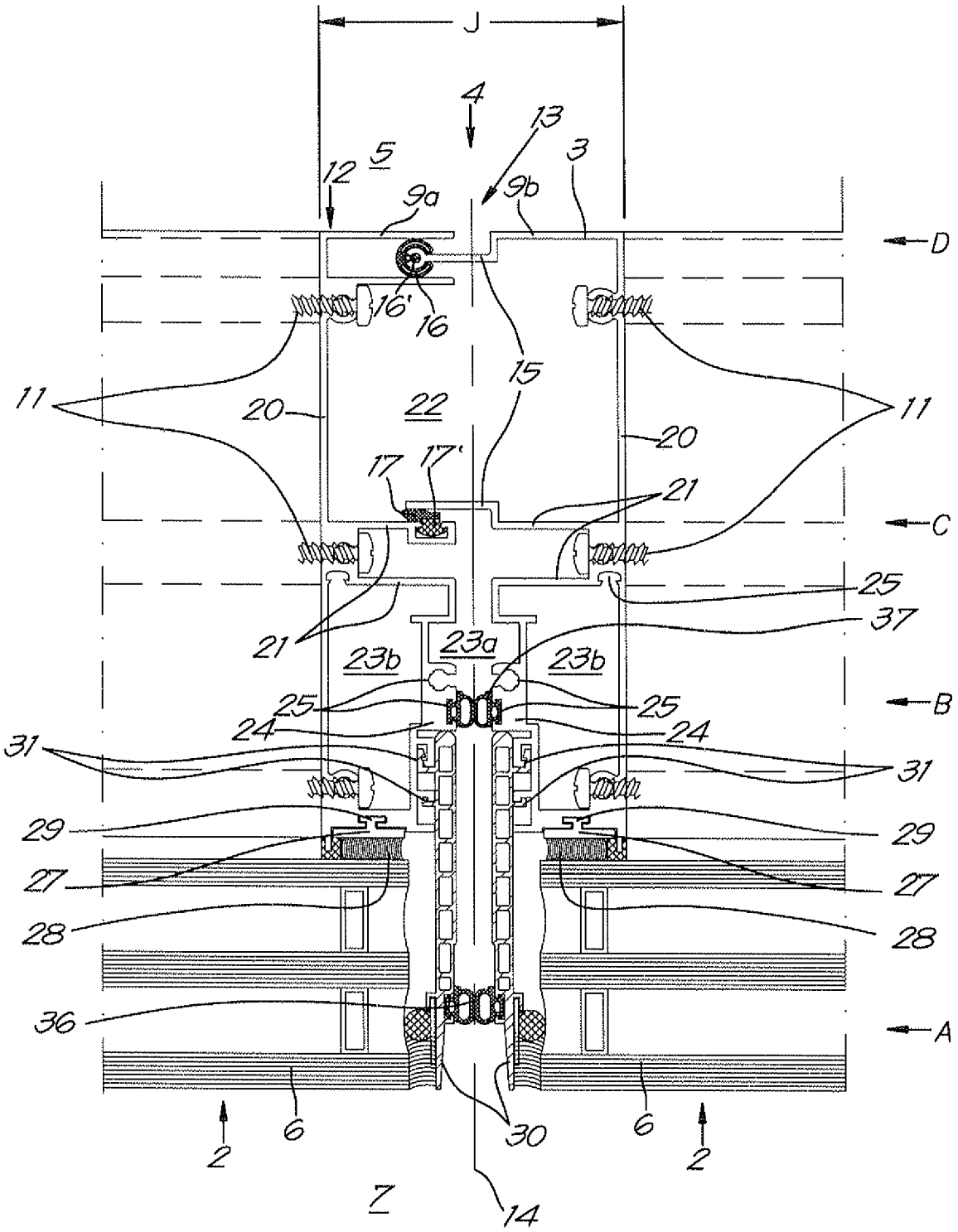
FIG. 3 shows a cross-section according to the line in FIG. 1.

As illustrated in FIG. 3 the basic frame 3 contains two types of mullions 9 that fit inside each another telescopically, respectively a mullion 9*a* with an open U-shaped female coupling part 12 and a mullion 9*b* with a complementary open U-shaped male coupling part 13, whereby the two types of mullions 9*a* and 9*b* slide with their coupling parts telescopically inside each other and whereby these mullions 9*a* and 9*b*, with the exception of the coupling parts, are as good as symmetrical relative to a median plane 14.

The mullions 9*a* and 9*b* of adjacent wall elements 2 are coupled to each other as shown in FIG. 3 and thus form in their coupled state a composite rectangular beam-shaped basic profile 4, as it were, consisting of two predominantly symmetrical semi-profiles 9*a* and 9*b* for the mullions and 10*a* and 10*b* for the transoms 10.

In the example the male coupling part 13 is formed by two parallel legs 15 which grasp between parallel walls of the female part 12 and are sealed off using seals 16 and 17 on the free end of the legs 15.

These seals are preferably formed by co-extrusion of one or two materials, respectively a rubber or suchlike and a stiff material to form a stiff foot 16' and 17' which allows the seal to be slid in the lengthways direction into the appropriate detailing during assembly of the frame 3.

In the example of the figures, the basic frame 3 contains three transoms 10, featuring a lower transom 10*a*, an upper transom 10*b* and one or more intermediate transoms 10*c*, in this case just one intermediate transom 10*c*, whereby the lower transom 10*a* and the one or more intermediate transoms 10*c* are mounted between the mullions, while the upper transom 10*b* is mounted on the mullions 9.

Figure 4:
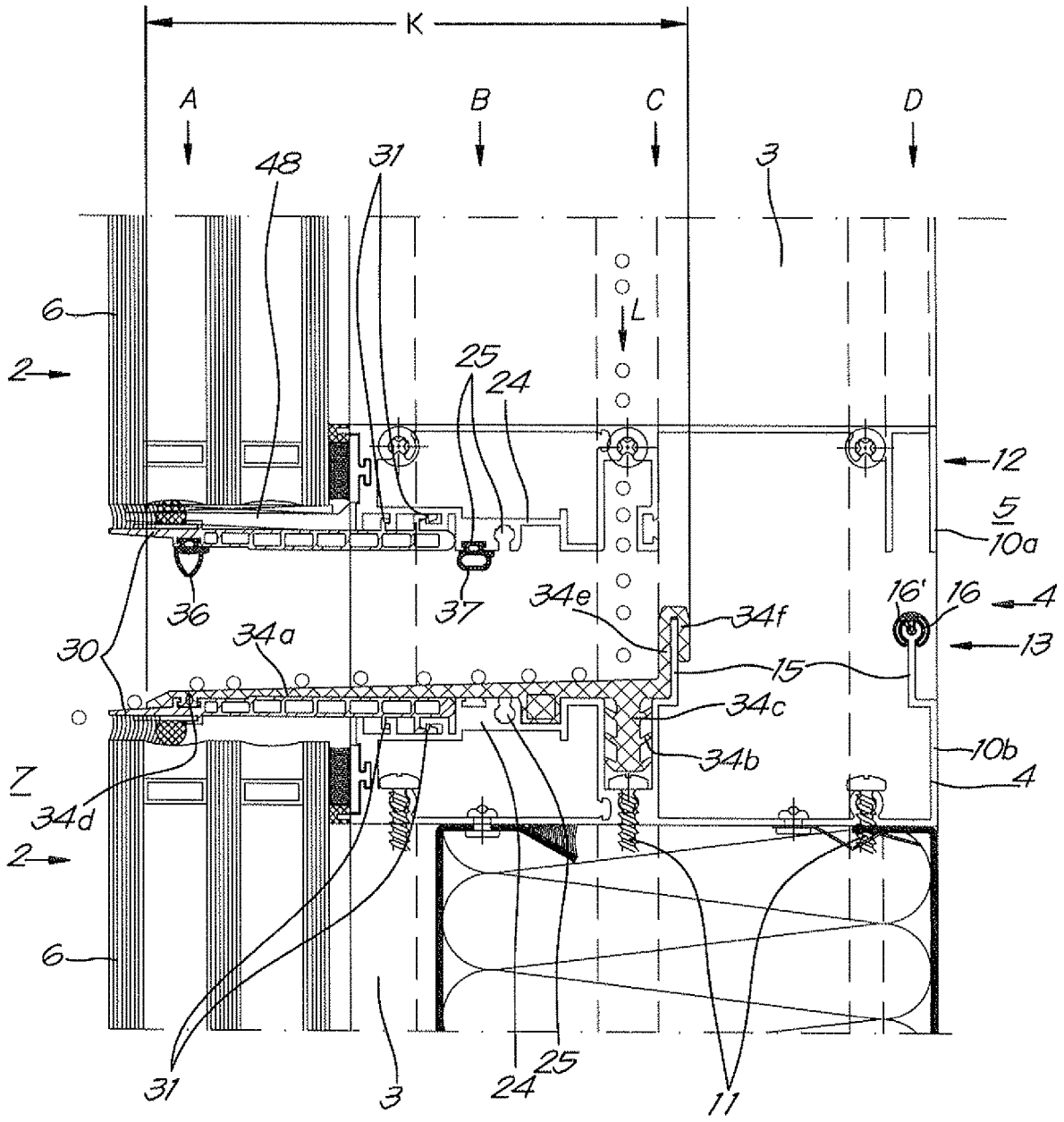
FIG. 4 shows a cross-section according to the line IV-IV in FIG. 1, yet in disassembled state.
Figure 5:
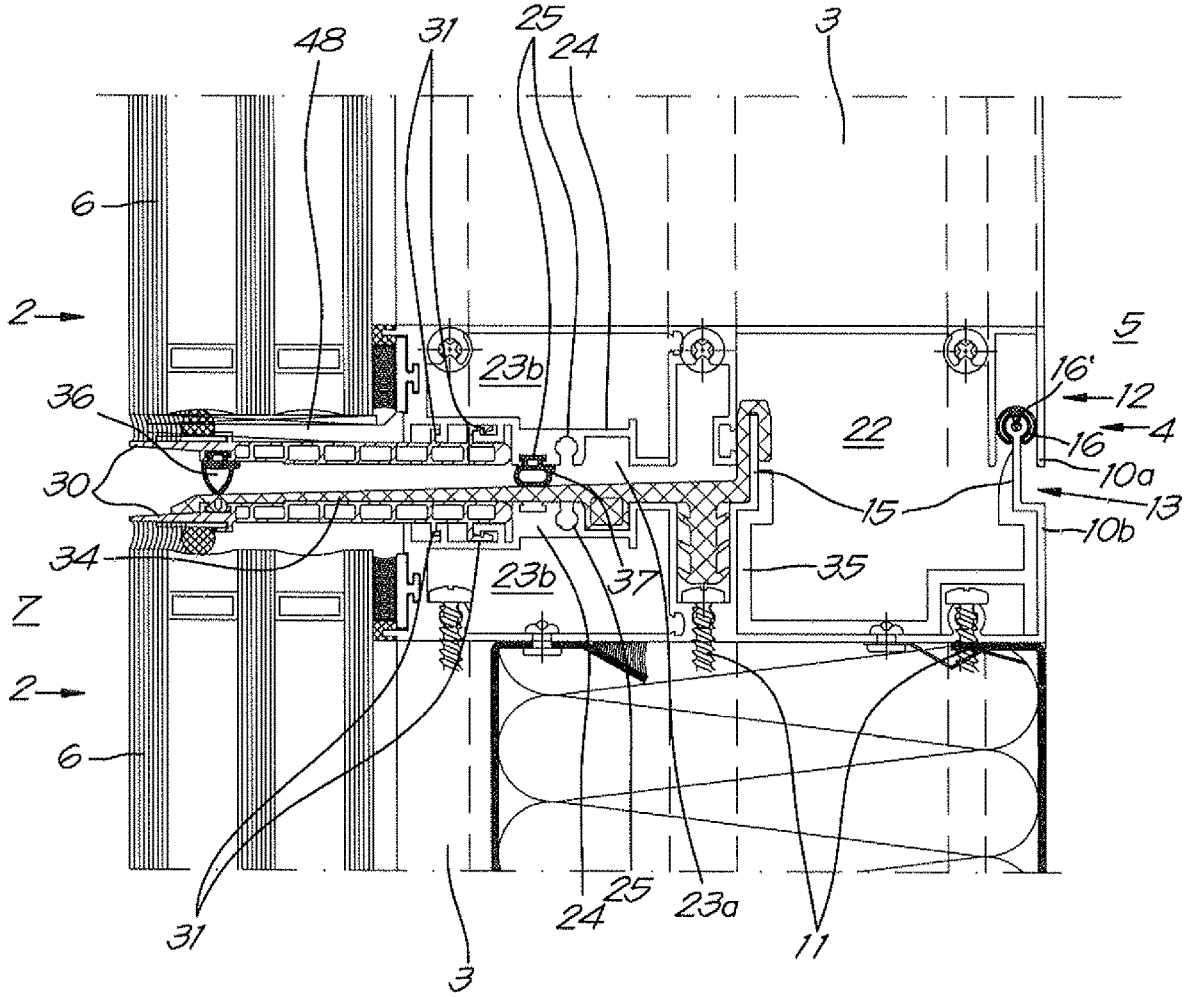
FIGS. 5 and 6 show cross-sections, respectively according to the lines V-V and VI-VI in FIG. 1.

In terms of profiling the upper transom 10*a* and the lower transom 10*b* are identical to the profiles of the mullions 9*a* and 9*b* and fit together in the same telescopic manner as shown in the FIGS. 4 and 5, whereby the lower transom 10*a* features a downward facing female coupling part 12 and the upper transom 10*b* features an upward facing male coupling part 13 that, when assembled, extends into the female coupling part 12 of a higher wall element 2. Just as the mullions 9*a* and 9*b*, the transoms 10*a* and 10*b* unite to form a composite profile 4 that, in terms of shape, is predominantly in line with the aforementioned basic profile 4.

Figure 6:
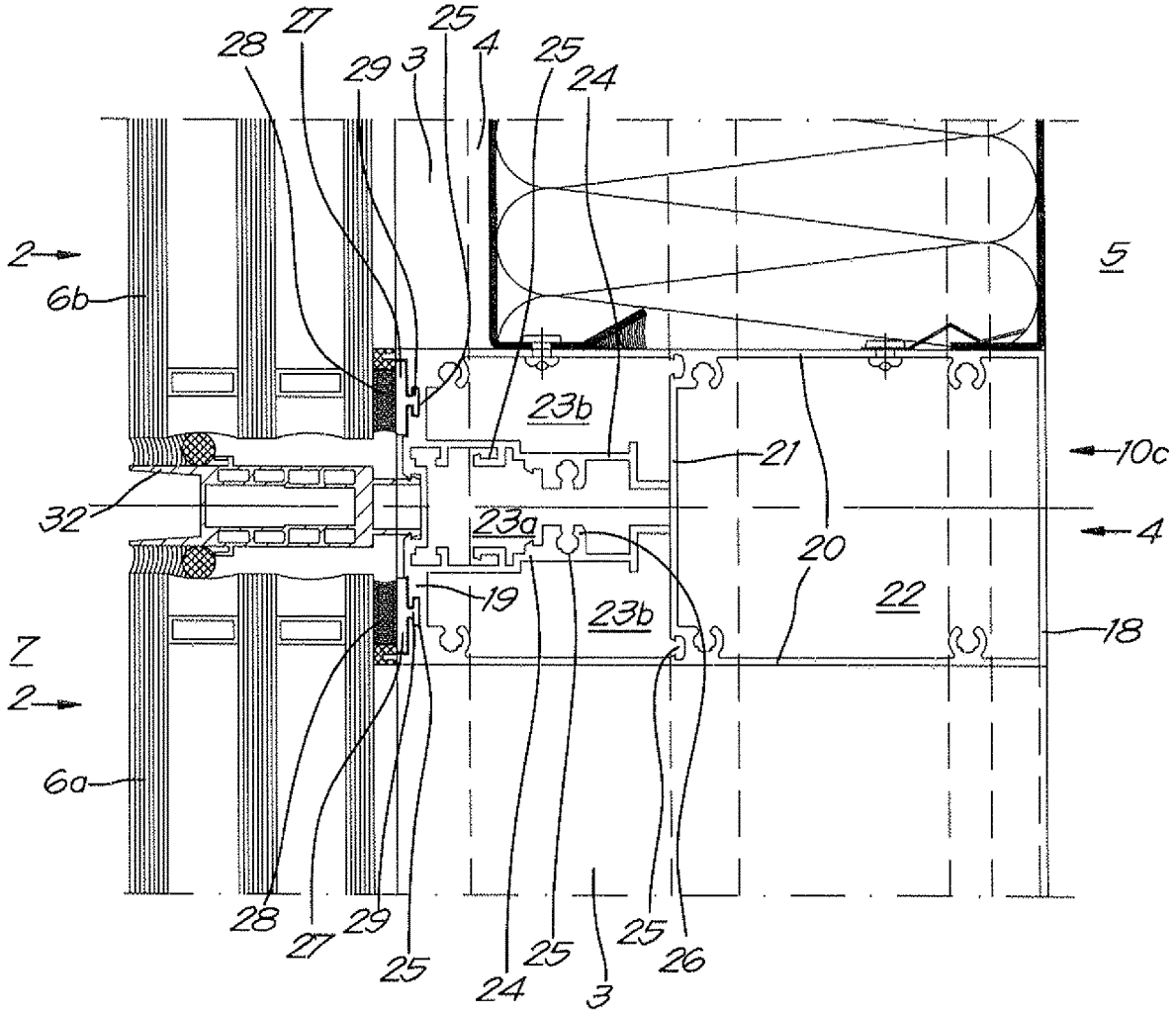
Figure 7:
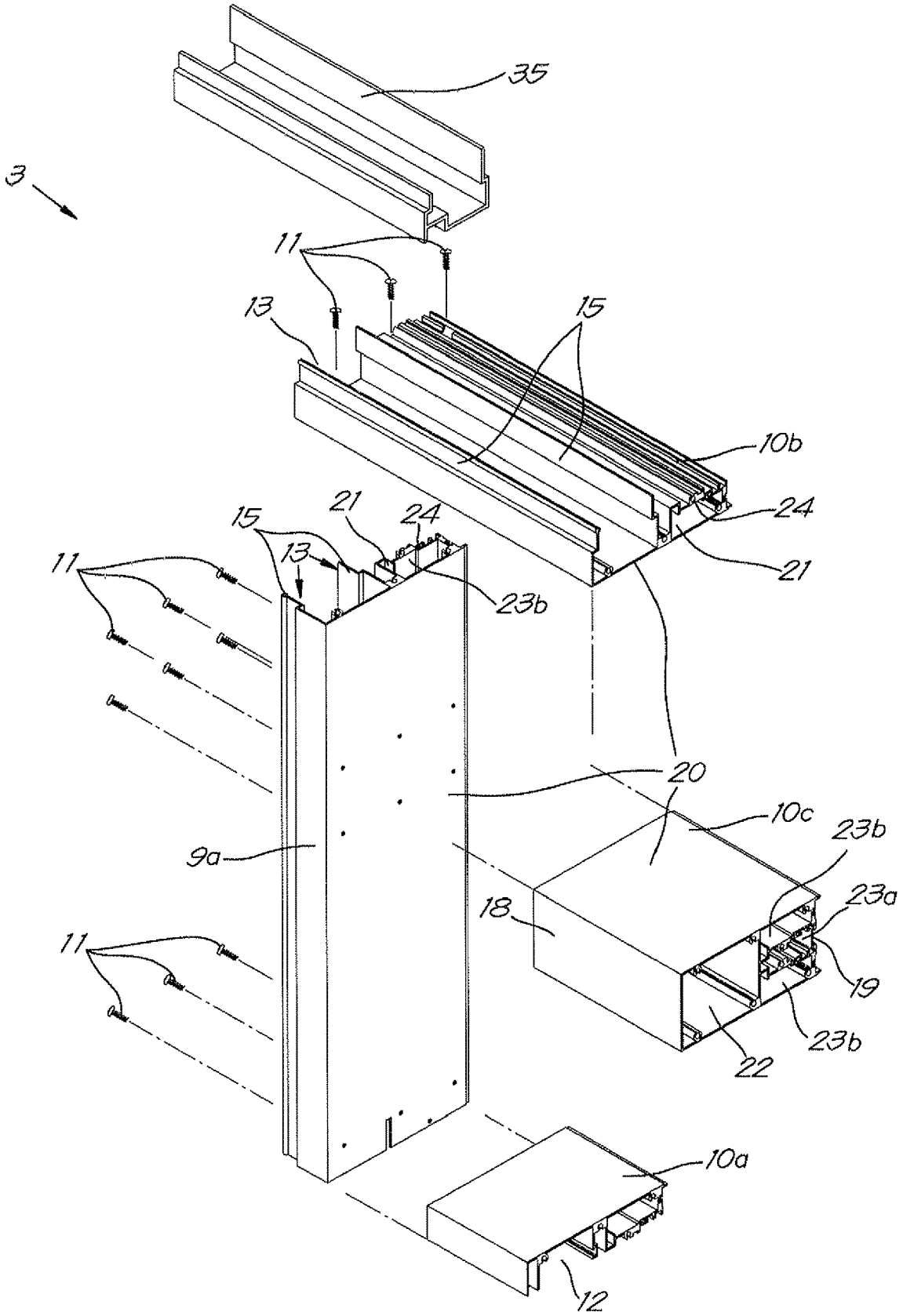
FIGS. 7 to 9 show in perspective and in disassembled state certain component parts of a wall element such as that of FIG. 2.

The intermediate transom 10*c* divides the frame 3 into two compartments 3*a* and 3*b* and has a cross-section as illustrated in FIG. 6 which in profiling terms, with the exception of the female and male coupling parts, is predominantly aligned with the composite basic profile 4.

The frame structure of the curtain wall 1 consequently appears to be composed exclusively of identical basic profiles 4, regardless of whether it is composed for the composite mullions 9*a* and 9*b* and transoms 10*a* and 10*b* or for the intermediate transoms 10*c*.

The basic profile 4 in FIG. 6 in line with an intermediate transom 10*c* is a rectangular tube profile with an inside wall 18 and an outside wall 19, i.e. an inside wall 18 facing the inside 5 of the curtain wall 1 and an outside wall 19 facing the outside 7 of the curtain wall 1 against which the infill elements 6 are attached, whose walls 18 and 19 are connected to each other by two parallel side walls 20.

The basic profile 4 is divided into two chambers using a partition 21 at a distance from the inside wall 18 and from the outside wall 19, respectively an inside chamber 22 on the inside 5 of the curtain wall 1 and an outside chamber 23 on the outside 7 of the curtain wall 1, whereby the outside chamber 23 is subdivided using two connecting walls 24 between the outside wall 19 and the partition 21 into three internal chambers, respectively into a middle chamber 23*a* and two internal side chambers 23*b* on each side of the middle chamber 23*a*.

As shown in FIGS. 4 and 5 the composite mullions 9 and transoms 10 substantially contain the same characteristics with the difference that the inside chamber 22 is now formed by the female and male coupling parts 12 and 13 which engage with each other and that the middle chamber 23*a* is now open and the partition 21 is realised with a double wall and divided into two parts.

The internal side chambers 23*b* are thus contained by 4 walls, namely by an outside wall 19, a side wall 20, a partition 21 and a connecting wall 24.

The connecting walls 24 of the internal side chambers 23*b* feature identical yet symmetrical detailing 25 on the sides facing each other for the attachment of seals or other components plus a protruding part 26.

Also, the outside wall 19 is fitted with detailing 25 at the level of the middle chamber 23*a* and, at the level of each internal side chamber 23*b*, with detailing 25 in the form of T-shaped recesses provided for the attachment of the infill elements 6 using aluminium slats 27 which are glued all the way around the inside of the infill elements 6 with structural silicone 28, for example structural silicone, whereby the slats 27 feature a T-shaped foot 29 which can be slid to fit into an aforementioned T-shaped recess. The slats 27 need to undergo an individual check to ensure that their surface treatment will not come loose when used in structural glazing.

Also, the partition 21 features detailing 25 on the inside of the internal side chamber 23*b* for assembly of seals or suchlike.

The transoms 10 and mullions 9 resemble semi-profiles 10*a* and 10*b*, respectively 9*a* and 9*b*, of the basic profile 4 featuring the same detailing 25.

Figure 8:
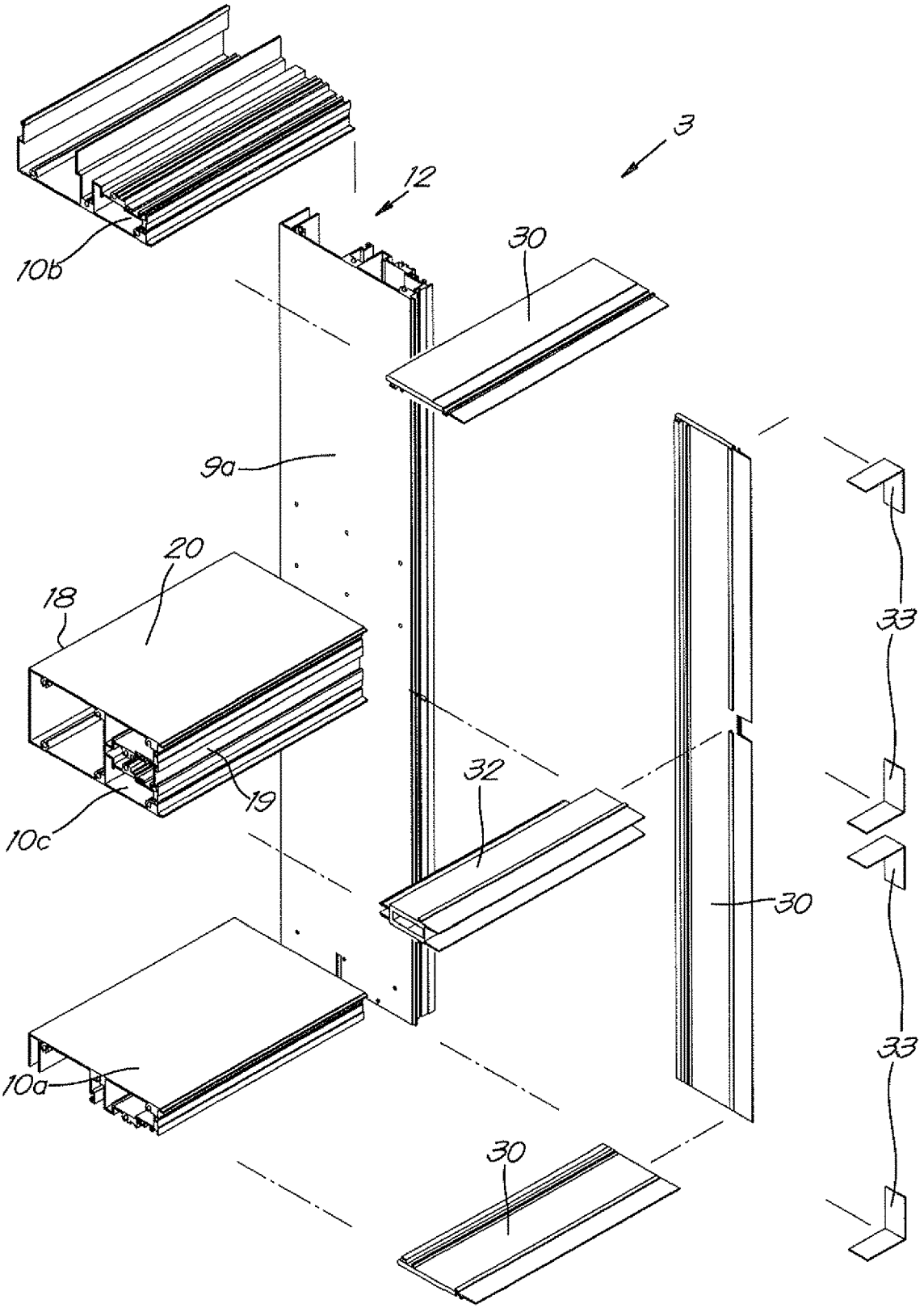

Around the perimeter of the infill element 6 insulation profiles 30 and 32 are fitted which, as shown in FIG. 8, are attached to mullions 9 and transoms 10 of the basic frame 3 using hooks 31 which, as shown in the FIGS. 3 and 4, are clicked into place in the specially-made detailing 25 on the connecting walls 24.

On the intermediate transom 10*c* an insulation profile 32 is attached as shown in FIG. 6, which connects the insulation profile 32 with the insulation profiles 30 of the mullions 9.

In the corners the insulation profiles 30 are joined together and the insulation profiles 30 of the mullions 10 are connected with the insulation profile 32 of the intermediate transom 10*c* using L-shaped corner connectors 33 as shown in FIG. 8 whose legs slide into the hollow insulation profiles 30 and 32.

The insulation profiles 30 and 32 extend from the frame 3 to the outside 7 of the curtain wall 1 over the thickness of the edges of the infill elements 6 and are sealed at their outward facing free ends in relation to the infill elements 6 using a silicone or other sealing kit.

As shown in FIG. 5, between two rows of connecting wall elements 2 a horizontal seal 34 is attached, which extends continuously in a horizontal direction over the breadth of the curtain wall 1 or a part of this wall and in doing so continues over the mullions 9 between neighbouring connecting wall elements 2, covering at least the corner connections between the mullions 9 and the transoms 10 of connecting wall elements 2.

This horizontal seal 34 is attached during construction of the curtain wall 1, as soon as a complete row of wall elements 2 or a part of such is constructed, on top of the row of wall elements 2 across the entire length of the row, after which assembly of a following row of wall elements 2 can begin as shown in FIG. 1 by clamping the horizontal seal 34 on the wall elements 2 below with the help of the profiling 34*b* and 34*d* without requiring other means of attachment such as screws or the like.

The horizontal seal 34 is a one-piece profile made of EPDM rubber or the like with a predominantly flat part 34*a* that rests on top of the row of wall elements 2 below and continuously covers the insulation profiles 30 of the wall elements 2 across the connecting perpendicular corner connections between the mullions and transoms of connecting wall elements 2 and this without making cuts or extra drilling and without any silicone.

This kind of EPDM rubber seal has the advantage of being a supple seal which can, for example, be rolled onto a roll and can then simply be rolled off this roll onto the wall elements 2 below and clamped together with the profilings 34*b* and 34*c* on the wall elements 2.

The length of the applied horizontal seals 34 are therefore required to be greater than the breadth J of the composite mullions 9*a*-9*b* as shown in FIG. 3 and is preferably such that several wall elements 2, preferably all wall elements 2, in a row of wall elements 2 can be bridged with this horizontal seal 34.

Should the length of a horizontal seal 34 be insufficient to cover the entire length of the row below, then use shall be made of several lengths of such a seal 34 connecting inside the breadth of a higher wall element 2 where there is no danger of a leak occurring at the side of this connection and where both extremities of the horizontal seal 34 are stuck together or vulcanised.

The top side of the flat part 34*a* slopes down towards the outside 7 of the curtain wall 1 to allow the good transit of water.

Preferably, the breadth K of the horizontal seal 34 is such that it stretches from the aforementioned most outward located leg 15 to or almost to the outside 7 of the curtain wall 1, so that, when in situ, this horizontal seal 34 acts as a sort of sill for the drainage of rainwater towards the outside 7 of the curtain wall 1.

Any infiltration water that might possibly infiltrate via the vertical joints will be carried away row by row via the underlying horizontal seal 34 towards the outside 7 of the curtain wall 1 as shown with indication L in FIG. 4. For the attachment of the horizontal seal 34 the flat part 34*a* on the underside is fitted with a downward facing profiling 34*b* which, as illustrated in FIG. 4, is fitted with barbs and which clamps tight into a groove contained by the walls or the double wall partition 21 of the underlying transom 10*b*.

The outward facing edge of the horizontal seal 34 is fitted with a first detailing 34*d* with which the seal 34 can be attached to the underlying insulation profile 30 and with a second detailing more towards the inside 5 of the curtain wall 1. In this way, the horizontal seal 34 is clamped onto an underlying wall element 2 in 3 places.

Furthermore, the horizontal seal 34 is made with an upstanding edge 34*e* of a height of for example 20 mm which extends into the female coupling part 12 of the lowest transom 10*a* of the wall elements 2 above and which clamps and seals between this female coupling part 12 and the upwardly extending leg 15 inside of the male coupling part 13 that is located closest to the outside 7 of the curtain wall 1.

The upstanding edge 34*e* keeps out any infiltration water and is fitted at the top with a hook-shaped bent end 34*f* that grasps the aforementioned upstanding leg 15.

At the level of the uppermost corners of connecting wall elements from an underlying row, the sideways connecting wall elements are connected together using a coupling profile 35 as shown in FIG. 5 in order to perfectly align the connecting wall element to ensure that the infill elements 6 on the outside 7 of the curtain wall 1 form a single surface.

Figure 9:
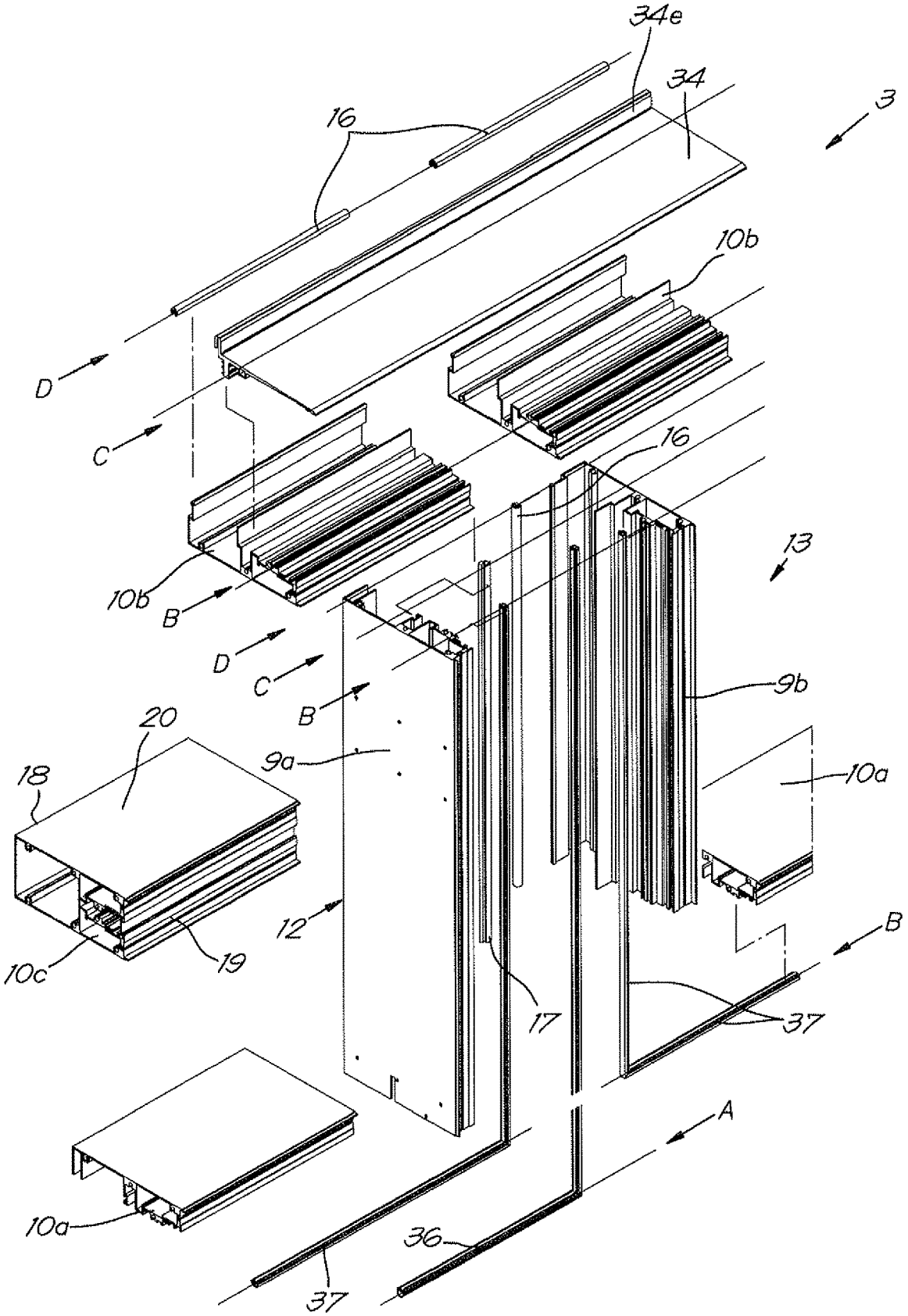

The wall elements 2 are sealed depth-wise along their perimeter from the outside 7 to the inside 5 of the curtain wall 1 on four levels A, B, C, D against each other as shown in the FIGS. 3, 4 and 9.

A first level A closest to the outside 7 of the curtain wall 1 is formed by first seals 36 which are attached respectively to the insulation profiles 30 of the mullions 9 and of the lowest transom 10*a*.

The second level B is formed by second seals 37 which are attached to the mullions 9 and to the lowest transom 10*a* of the basic frame 3 in a detailing 25 of the connecting walls 24.

The first and second seals 36 and 37 on the mullions seal each other, while the first and the second seals 36 and 37 seal the lowest transom 10*a* on the underlying horizontal seal 34.

The third level C is formed by the upstanding edge 34*e* of the horizontal seal 34 and by the aforementioned seals 17 between the female and male coupling parts 12 and 13.

The innermost fourth level is formed by the aforementioned seals 16 between the female and male coupling parts 12 and 13.

In this way a perfect water and airtight seal is achieved between the wall elements 2 and thanks to the continuous horizontal seal 34 also between the rows, whereby each row is isolated from another row in terms of water drainage and all the water from each row is transported via the horizontal seal 34 towards the outside 7 of the curtain wall 1.

Figure 10:
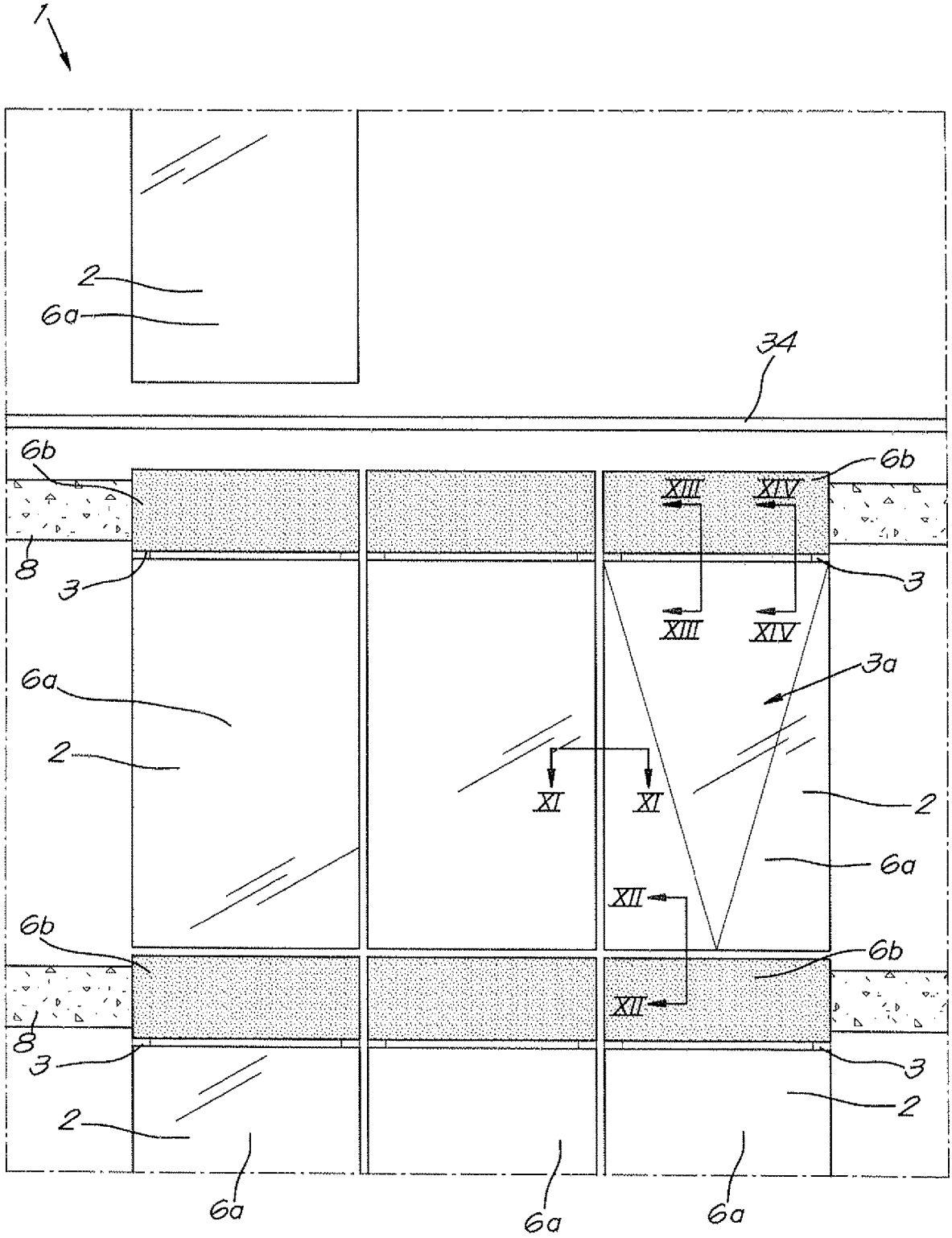
FIG. 10 shows a situation such as the one in FIG. 1 but whereby a wall element according to the invention is added with a wing that opens.

FIG. 10 shows a curtain wall 1 according to the invention whereby beside the wall elements 2 with fixed infill elements 6 a wall element 2 is now also fitted of which the one compartment 3*a* of the basic frame 3 is fitted with an outward-opening wing of a window while compartment 3*b* features a fixed infill element 6*a*.

The wing that opens is composed of a wing frame 3" and, attached to this wing frame 3", an infill element 6*a* that is fixed to the outside 7 of the wing frame 3" using structural silicone 28.

In terms of dimensions, the infill panel 6*a* of the wing is the same size as a fixed infill panel 6*a* and covers the wing frame 3" entirely or as good as entirely and is aligned with the other infill panels 6, so that no difference can be seen from the outside 7 of the curtain wall 1 between fixed infill panels 6 and infill panels of a wing.

When closed, the wing lies in a rebate 40 fitted along the perimeter of the compartment 3*a* of the wing in the basic frame 3, whereby this rebate 40 is formed by the fact that part of the internal chamber 23*b* of the mullions 9 and transoms 10 is missing or has been removed.

Figure 16:
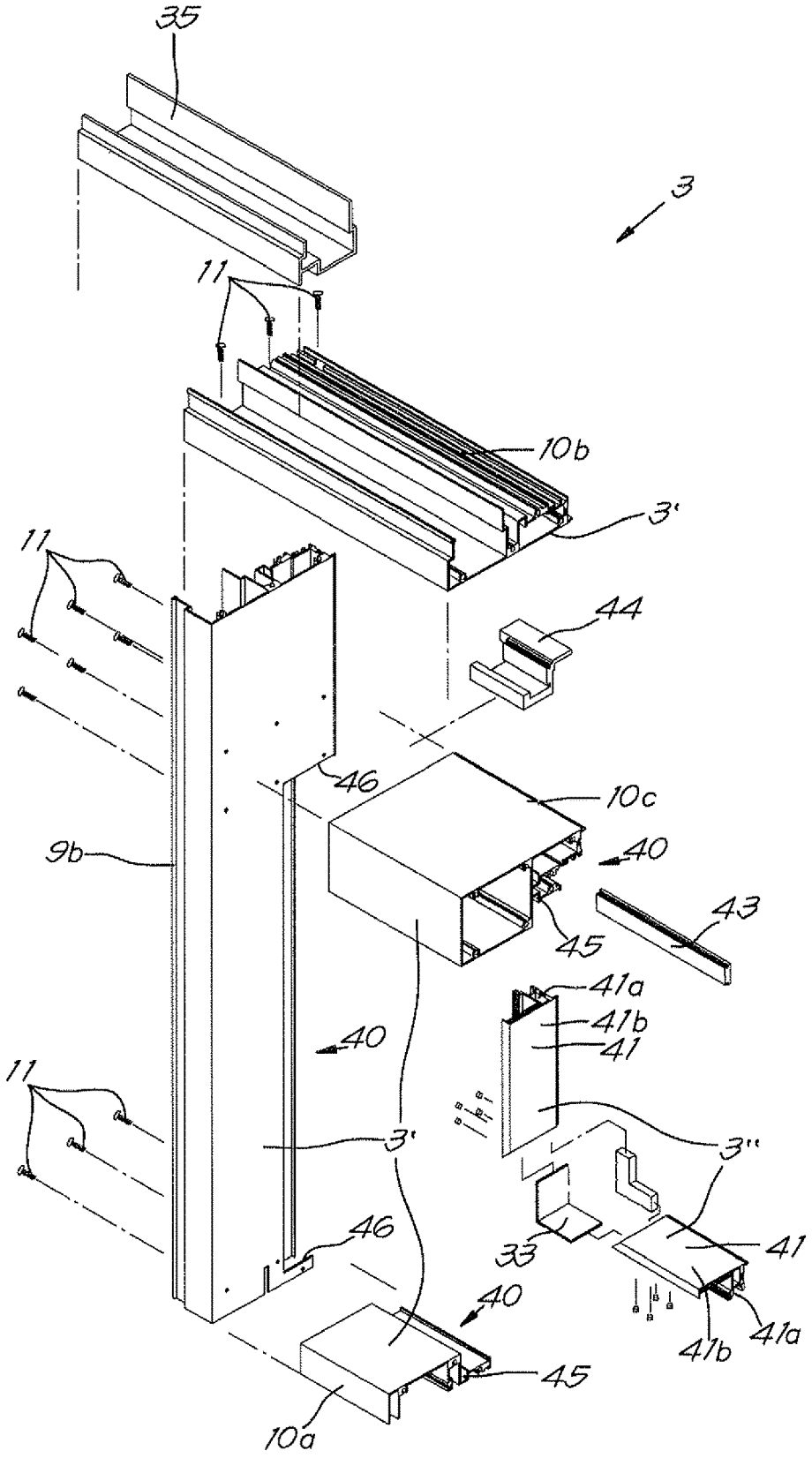
FIG. 16 shows the component parts of the frame of a wall element with a wing that opens.

As far as the mullions 9 are concerned the rebate 40 is formed by locally removing the mullions 9 in the basic frame 3 in line with the wing as shown in FIG. 16 whereby a part of the mullions 9 above and below the rebate is retained.

The rebate 40 is formed by opening the internal side chamber 23*b* by locally removing the side wall 20 of the internal side chamber 23*b* as far as the double walled partition 21, the outside wall 19 of the side chamber 23*b* and a part of the connecting wall 24 as far the protrusion 26.

The outward facing sides of the remaining partition 21 and of the protrusion 26 both form a stop for the wing frame 3", and do so with the intervention of a seal 38, respectively 39, to which the seal 38 is attached in the detailing 25 or the partition 21 and the seal 39 is attached to the wing frame 3".

Equally the transoms 10 on the top and bottom side of the winged compartment 3*a* feature an appropriate rebate 40 spanning their entire length.

With the fact that the rebate 40 stretches over the entire length, the transoms 10 made by profiles 10*a* and 10*c* can already allow for such a rebate 40 during fabrication or by using profiles with an internal chamber 23*b* which is opened across the entire length in the same way as for the rebates 40 in the mullions 9.

When ground in this way the mullions, on the one hand, and transoms extruded with the rebate, on the other, of the basic frame 3 thus form the external frame of the window as it were, so that no separate external frame is required to make a window that opens as is the case in traditionally known curtain walls. The invention lies in the fact that by applying the grinding technique to the mullions—where required in a wall compartment 3*a* featuring a wing that opens —, in the adjoining compartment or in the adjoining compartments of the same wall module and featuring a fixed infill element, no additional frame is required around these fixed infill elements in order to be able to place these in the basic frame 3, contrary to all existing systems.

The wing frame 3" of the wing is formed by profiles 41 which are predominantly L-shaped with a leg 41*a* and a leg 41*b*, this wing frame 3" with its outward facing side facing the outer face 7 of the curtain wall 1 with one leg 41*a* using an aforementioned aluminium slat 27 all around being glued against the inside of the infill element that opens 6*a* using a structural silicone 28 and with the other leg 41*b* facing in a perpendicular direction to this internal side.

The seal 39 and a shortened insulation profile 30" are attached to the leg 41*a*.

The rebate 40 is measured with ample room for traditional hardware 42, for example in the form of friction hinges.

For the intermediate transom 10*c* with rebate 40 in line with the protrusions 26 of the remaining connecting walls 24 an extra insulation slat 43 is attached as shown in the FIGS. 13 and 16.

Figure 15:
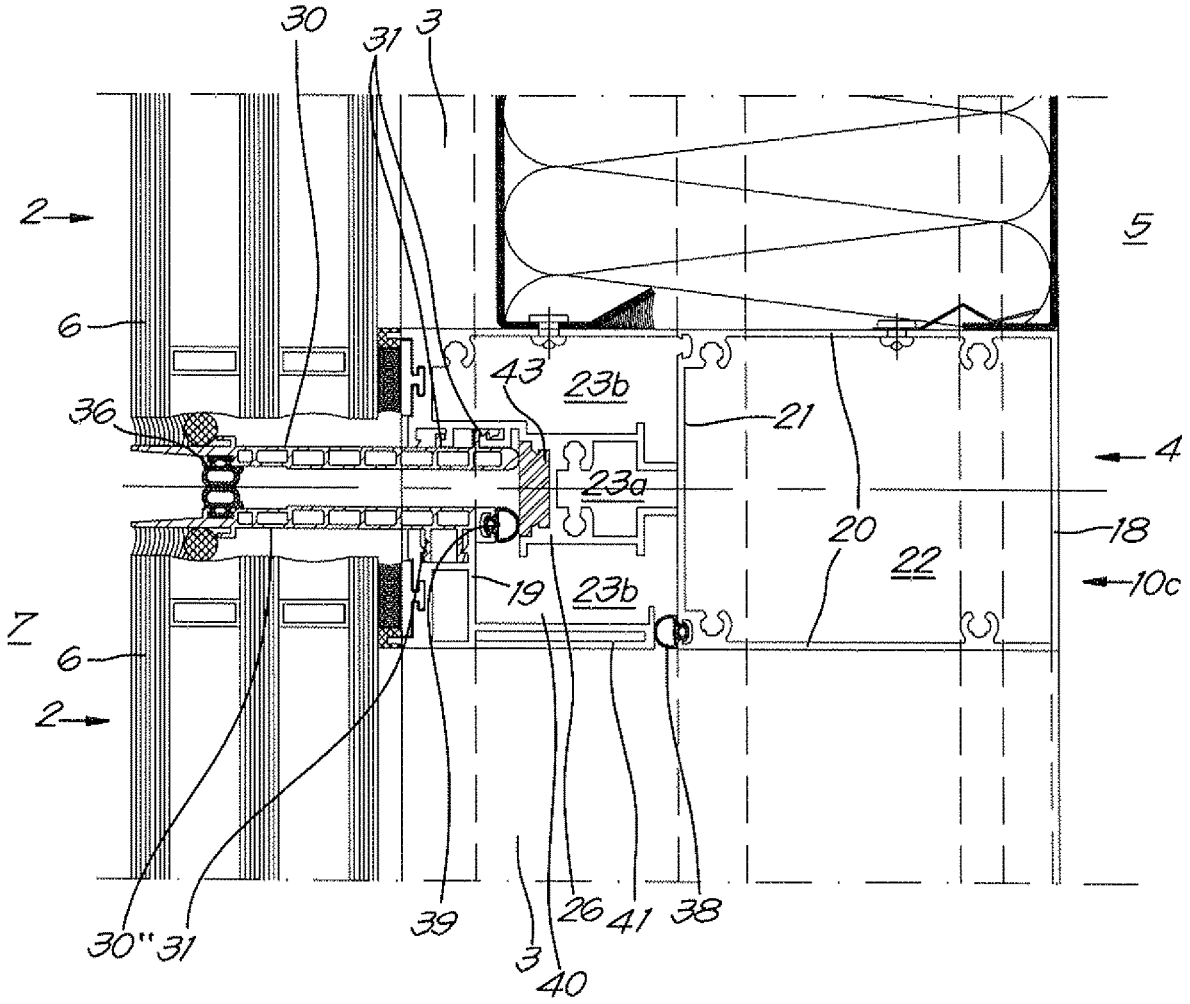
FIG. 15 shows a cross-section according to line XV-XV in FIG. 14.
Figure 14:
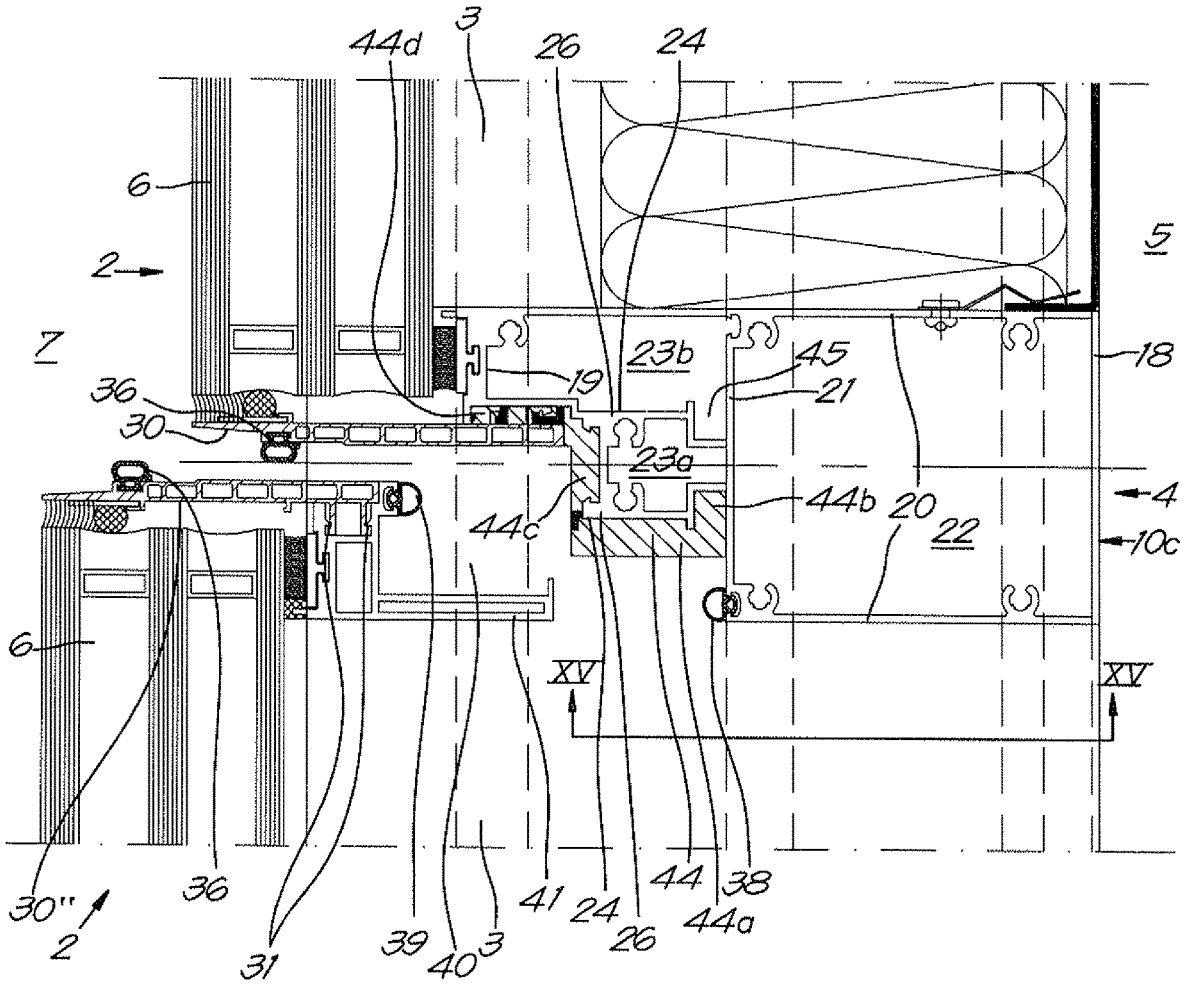
Figure 15:
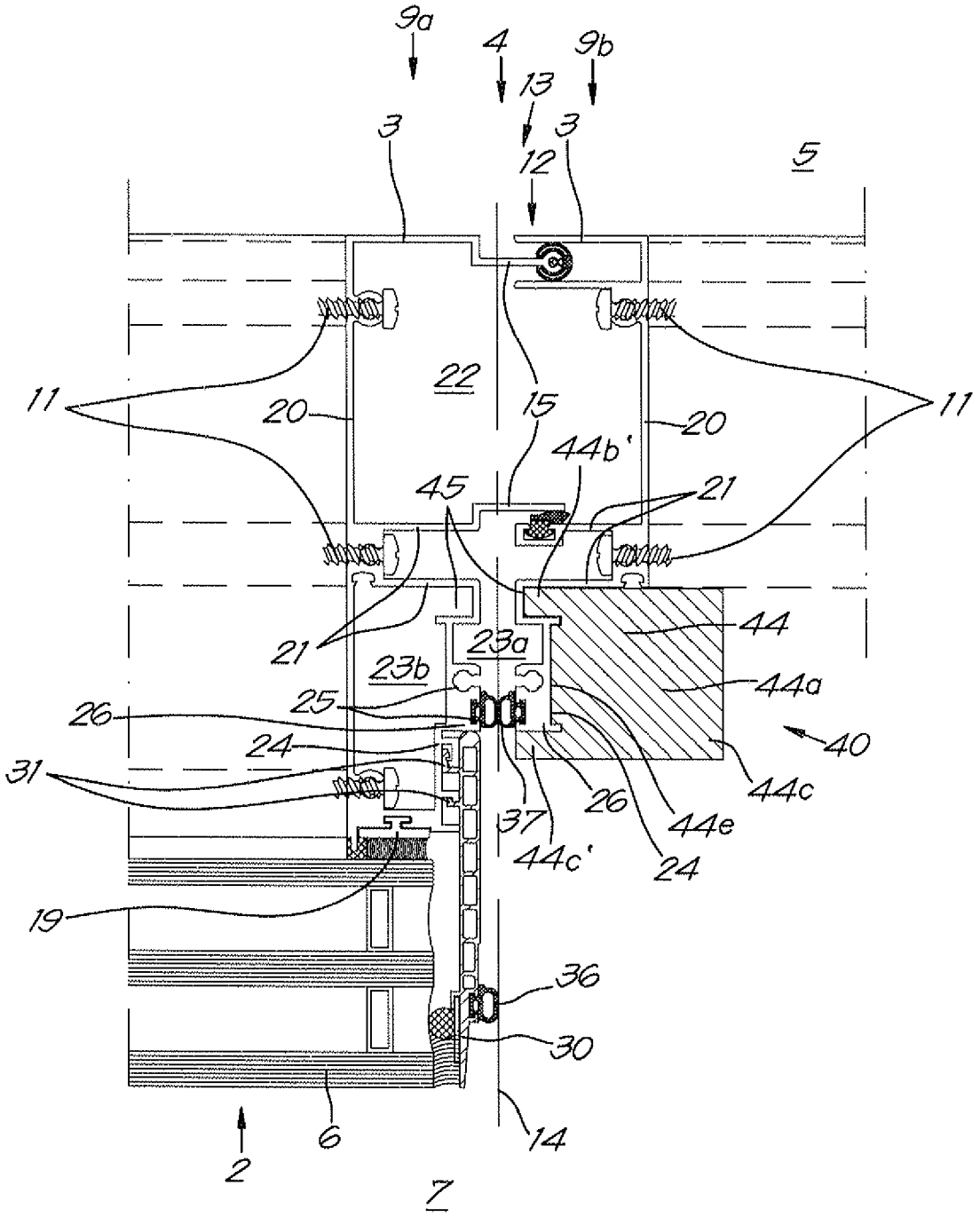
Figure 17:
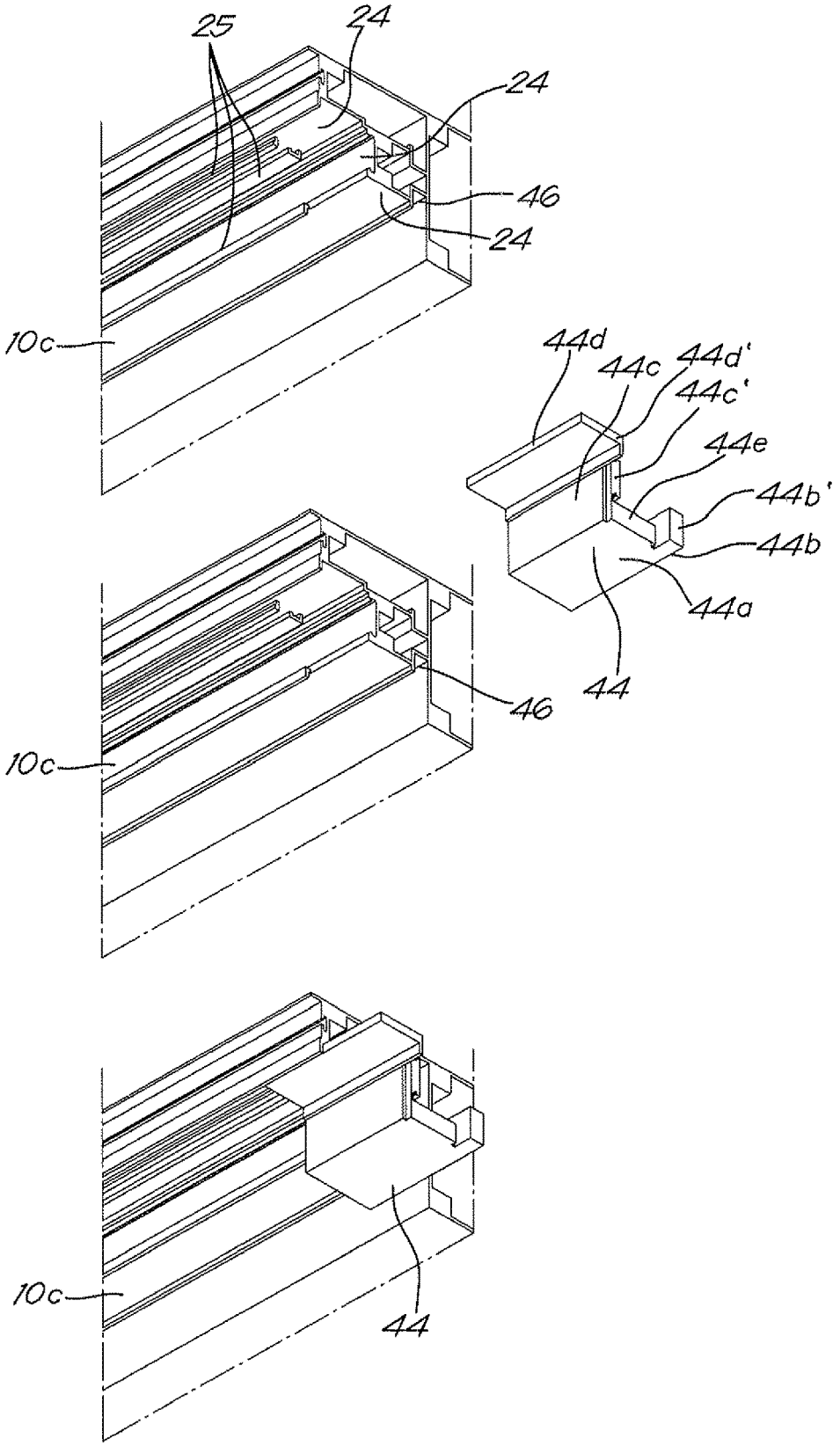
FIGS. 17 and 18 show the way to assemble the component indicated in FIG. 16 with F17.
Figure 18:
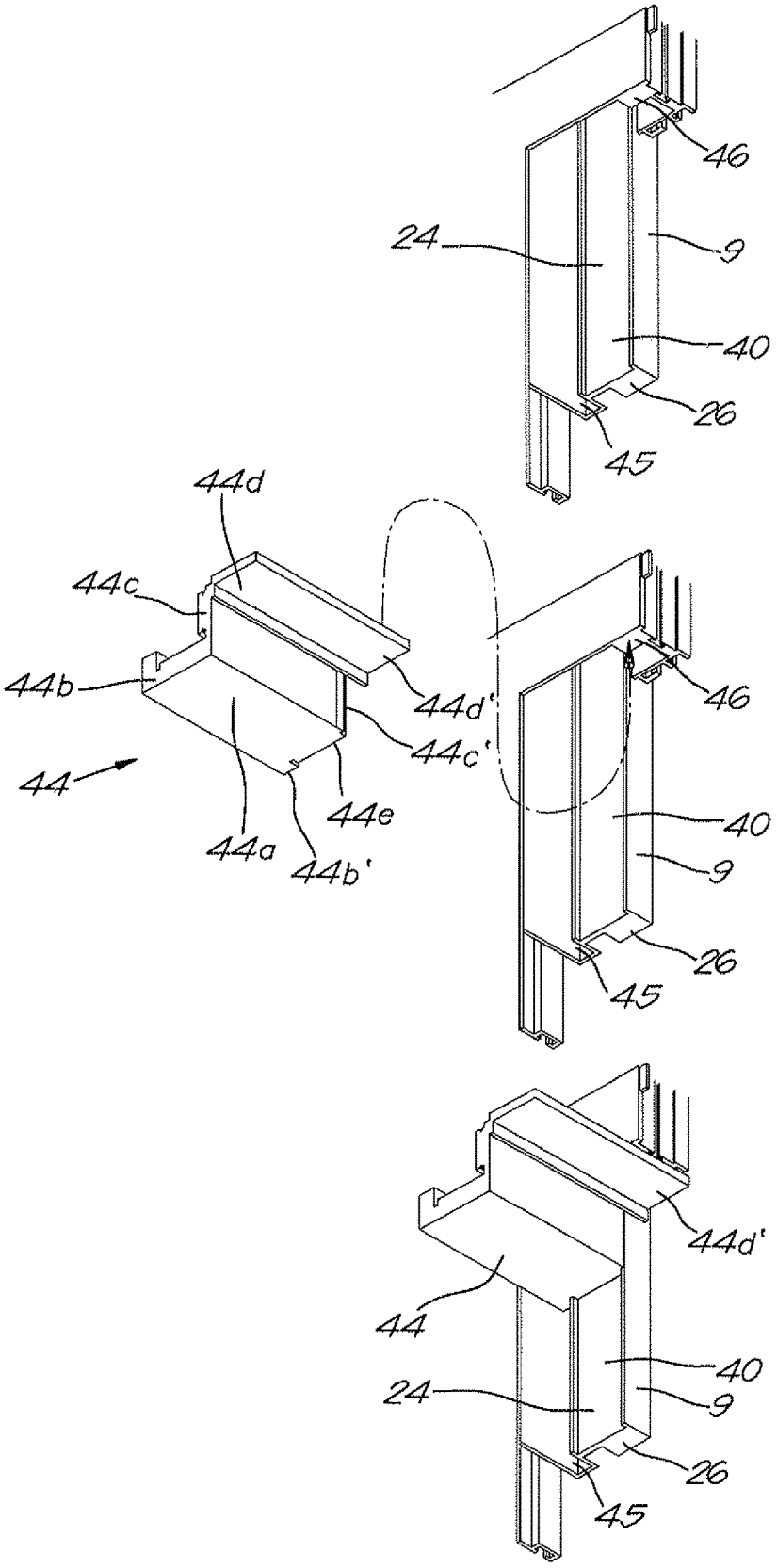

In the corners of the basic frame 3 a sealing corner piece 44 made of rubber, plastic or other sealing material is fitted against the inside of the rebate 40 and this is shown in the cross-sections of the FIGS. 14 and 15 and of which the installation is clarified using the FIGS. 16 to 18.

The corner pieces 40 are intended to perfectly seal the perpendicular corner connections between mullions 9 and transoms 10. After all, wind and rain penetrating the rebate between the basic frame 3 and the wing frame 3" must be stopped from entering the inside 5 of the curtain wall 1 via this corner connection.

The corner piece 44 shown in the figures is formed and sized in such a way that it attaches level with the rebate 40 in the intermediate transom 10*c* against the underside of the remaining connecting walls 24 and against the outside of the remaining protrusions 26 as shown in FIG. 14 and in FIG. 17 at the bottom.

As shown in FIG. 17 certain detailing 25 can therefore be removed in the corners across a particular length M by grinding or the like in order to obtain flat surfaces against which the corner piece 44 can be properly attached without the corner piece 44 needing to be made in a complex shape.

The length M across which the detailing 25 is removed can be chosen in such a way that when tightening the transom 10 against a connecting mullion 9 during assembly, the corner piece 44 is clamped between the remaining part of the overlying detailing 25 of the transom 10 and the connecting mullion 9.

As far as the corner pieces 44 in the corners of the intermediate transom 10*c* are concerned, the corner piece 44 in vertical cross-section is predominantly U-shaped with a back 44*a* and a short leg 44*b* and a long leg 44*c* and, on the free edge of the long leg 44*c* an outward stretching lip 44*d* that is perpendicular to this leg 44*c* and which adjoins a connecting wall 24 of a connecting side chamber 23*b*.

The short leg 44*b* therefore sits tightly in an upward-reaching groove 46 of a connecting wall 24 of the intermediate transom 10*c* of the fixed basic frame 3.

In this same way, in the corners of the lowest part transom 10*a* an analogue corner piece 44 is attached with the short leg 44*b* fitting into a corresponding downward-facing groove 45 of this part transom 10*a* on the basic frame 3.

In the horizontal cross-section of FIG. 15 and in FIG. 18 at the bottom it is possible to see that the corner piece 44 with a side edge 44*e* of the back 44*a* connects against the remaining part of the connecting wall 24 of the rebate 40.

The short leg 44*b* is extended sideways past the edge 44*e* of the back 44*a* and sits sideways with this extended part 44*b*' contained sideways in the groove 45 of a mullion 9.

The long leg 44*c* is also extended sideways and uses this extended part 44*c*' to grip across the protrusion 26 of the remaining connecting wall 24.

Also, the lip 44*d* is extended with a part 44*d*' beyond the edge 44*e* into the rebate 40 of the connecting mullion 9, thus buffed up against the cut edges 46 which limit the rebate 40 in the mullions on the top and bottom.

The corner pieces 44 are preferably glued into the fixed basic frame 3.

It is clear that a corner piece 44 for connection to the left-hand mullion 9 is the mirror image of the corner piece 44 of the figures for connection to the right-hand mullion 9.

It is clear that the corner pieces for the lowest transom 10*a* must vary somewhat from the corner piece 44 of the figures.

As the corner pieces 44 are made of rubber or another supple or semi-supple sealing material, these corner pieces 44 can cope with differential settings and the potential warping or distortion of the basic frame 3 without harming the water and airtight function and are able to do this without the use of any silicone or other kit material.

The corner pieces 44 are attached during the wall builder's production process in the factory and consequently under perfect quality control. As such, for example, the corner pieces are slid onto the ends of the transoms during production before the transoms are attached between the mullions 9 and are screwed tightly in-between.

When the wing is opened the corner pieces 44 become visible, but this causes no problem. A curtain wall 1 system according to the invention is particularly well-suited to the prefabrication of wall elements 2, be these fixed wall elements with fixed infill elements 6 or wall elements with a wing that opens, on an automated production line under working conditions that can be accurately controlled, therefore guaranteeing a perfect finish.

Figure 19A:
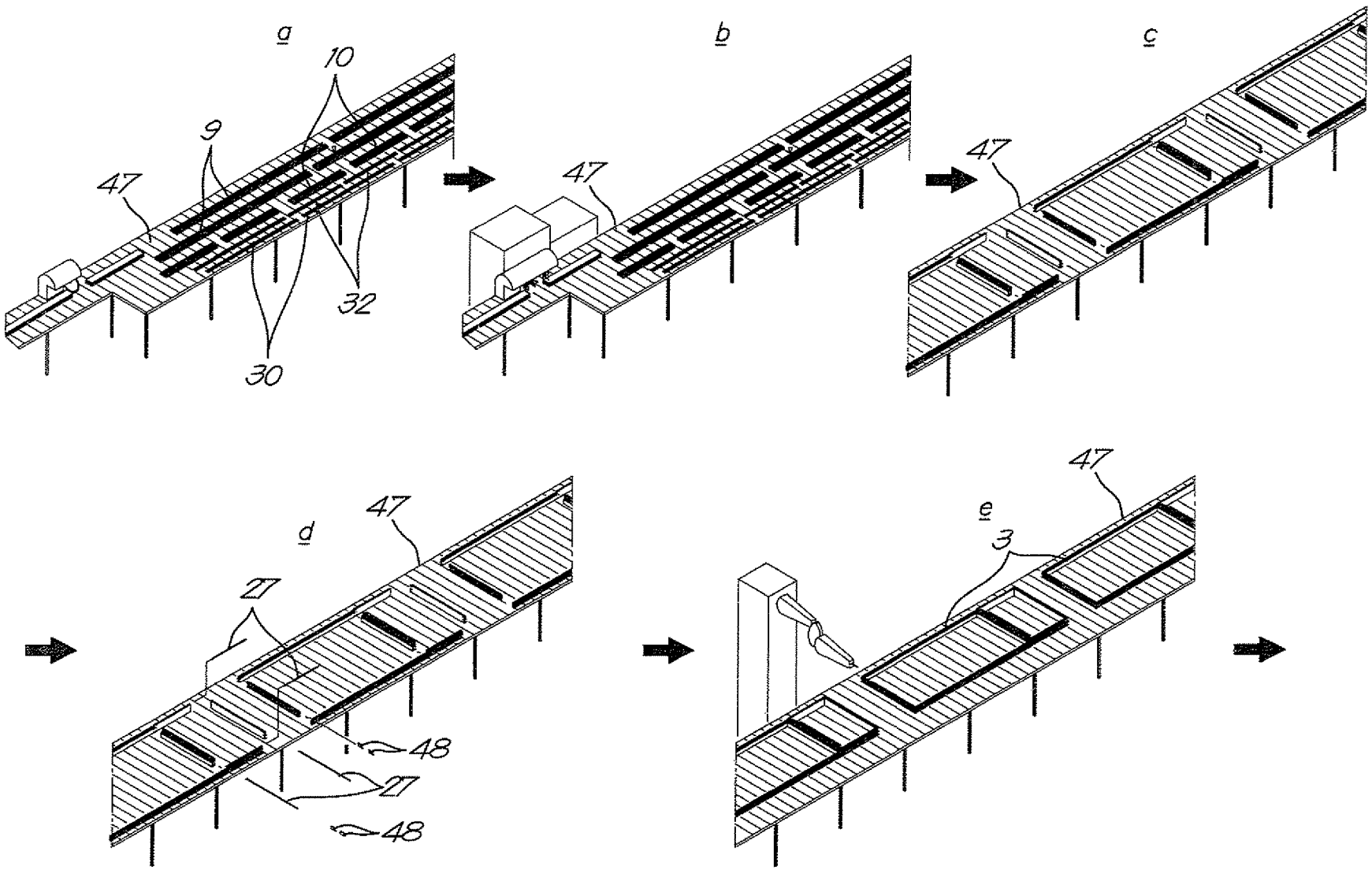
FIGS. 19A and 19B show a production line for the manufacture of wall elements according to the invention.
Figure 19B:
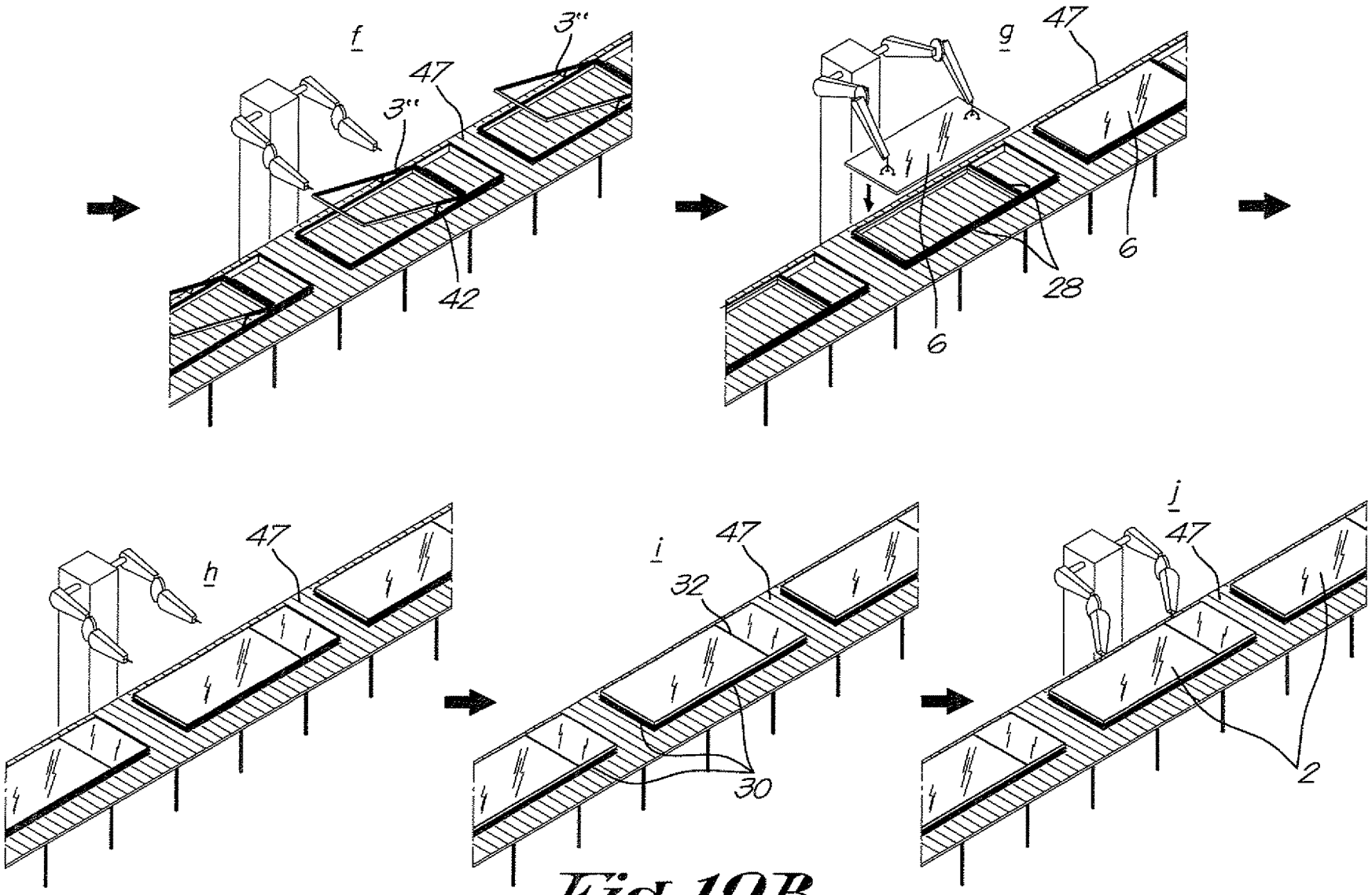

Such a production line is shown in a diagram in the FIGS. 19A and 19B in which use is made of a production line 47.

The production of the glazed wall elements 2 is carried out in the ten consecutive steps a through j as shown in FIG. 19:

a/cutting all the profiles of the mullions 9 and transoms 10 and the insulation profiles 30 and 32 to the right length;

b/machining, and if necessary grinding, the profiles using an automated machining device to create a rebate 40;

c/positioning the profiles on the production line 47 with the inside of the mullions 9 and transoms 10 facing downwards in a position relative to the frame 3 under fabrication;

d/sliding in the aluminium slats 27 to allow structural gluing of the infill elements 6 and the attachment of the glass supports 48;

e/assembling the frames 3 by placing the screws 11 which connect the mullions 9 with the transoms 10 and installing all rubber seals 16, 17, 36, 37, 38, 39 and corner pieces 44;

f/placing the wing frames 3" for the wings that open and for the required hardware 42 in the compartments in which a wing that opens is anticipated;

g/installing the infill elements 6;

h/applying the structural silicone 28;

i/placing and securing the insulation profiles 30 and 32 for the thermal break;

j/sealing the insulation profiles 30 and 32 along the edges of the infill elements 6 with the help of a silicone or other sealing kit.

It should be noted that throughout the entire production process the frames remain flat on the production line and consequently no time-consuming manipulation is required to turn the frames over, something that saves significant amounts of time.

It should also be noted that the prefabricated wall elements 2 are already fitted with all seals during production in a controlled environment, with the exception of the horizontal seal 34 which is only attached during assembly in the curtain wall 1 in a row of in situ wall elements 2 before a following row wall elements is installed.

Figure 20:
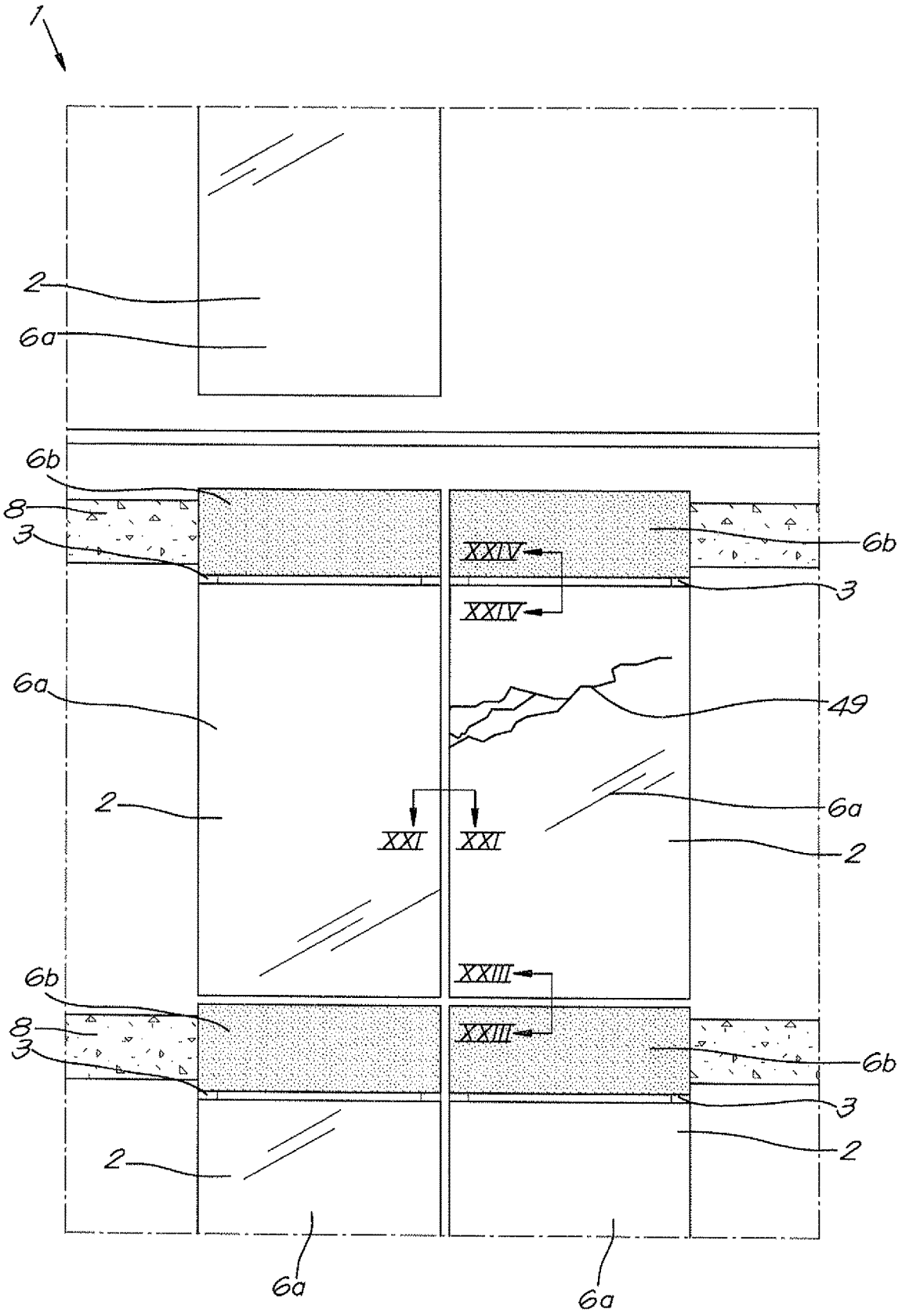
FIG. 20 shows a situation such as the one in FIG. 12 but whereby one wall element displays a cracked or damaged infill element that requires replacement.

Furthermore, the system of a curtain wall 1 according to the invention is highly suitable for the replacement of a fixed infill element 6*a*, for example due to damage or a crack 49 in the infill element 6*a* in a compartment 3*a* as shown in FIG. 20 or for whatever other reason.

Figure 11:
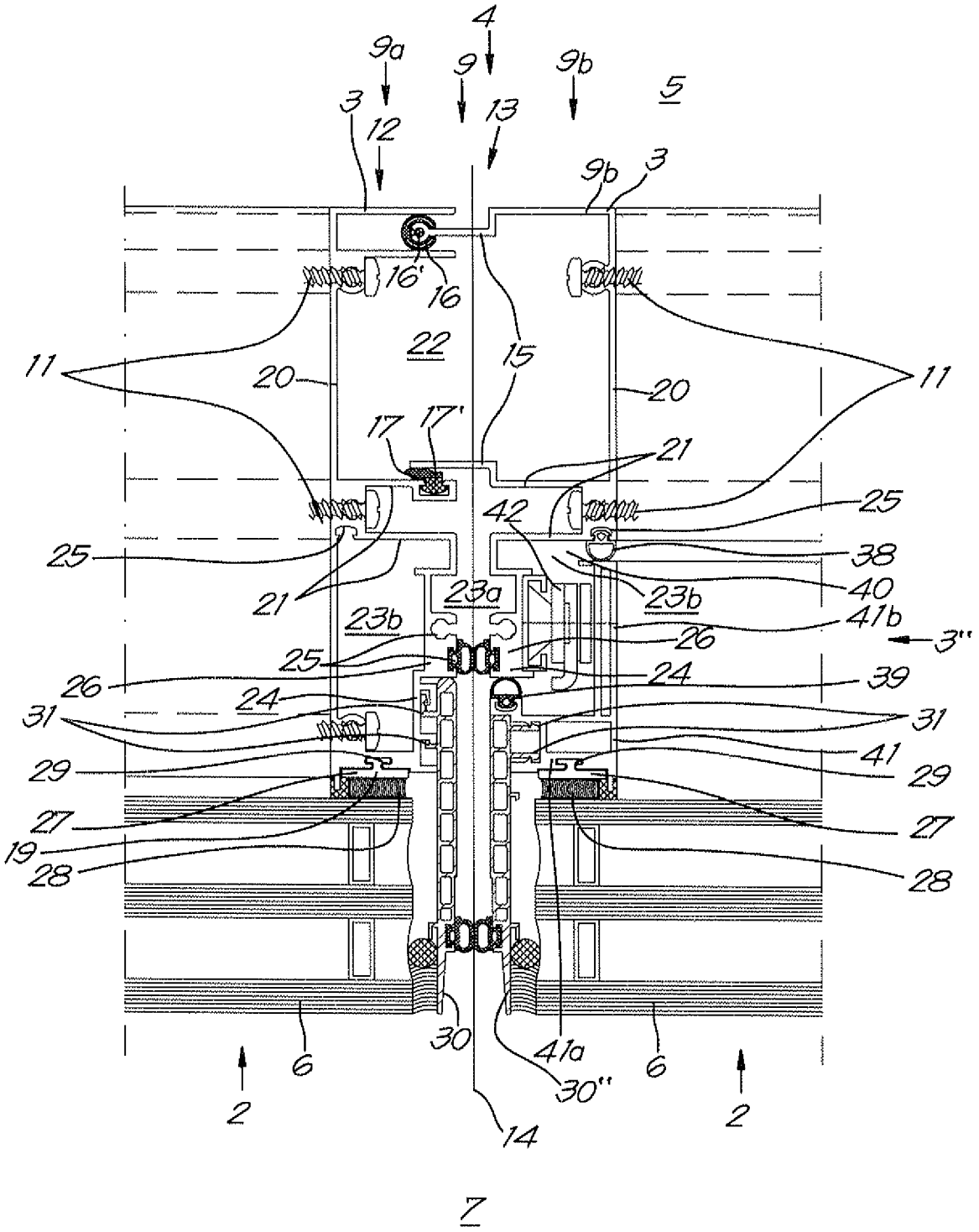
Figure 12:
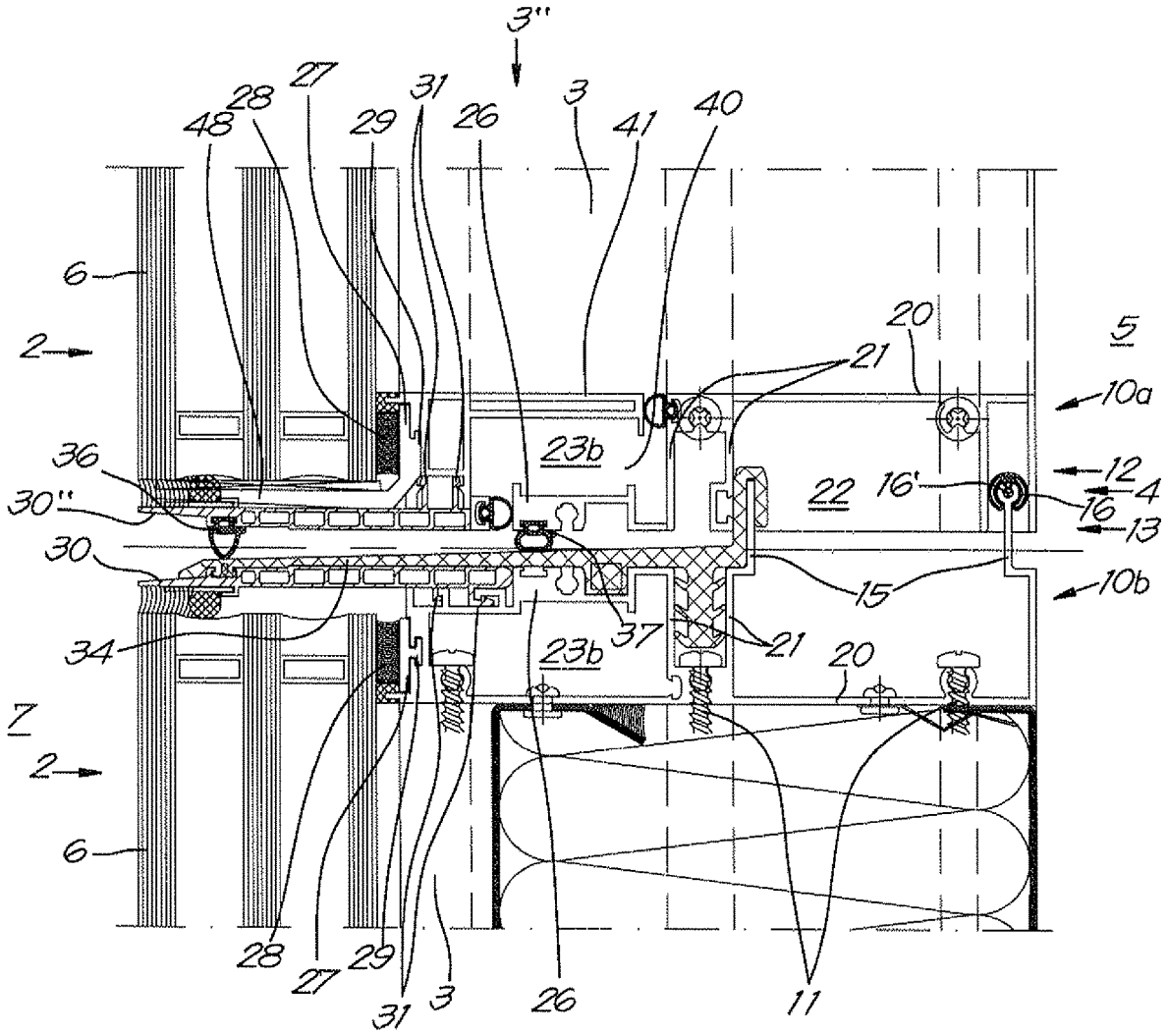
Figure 22:
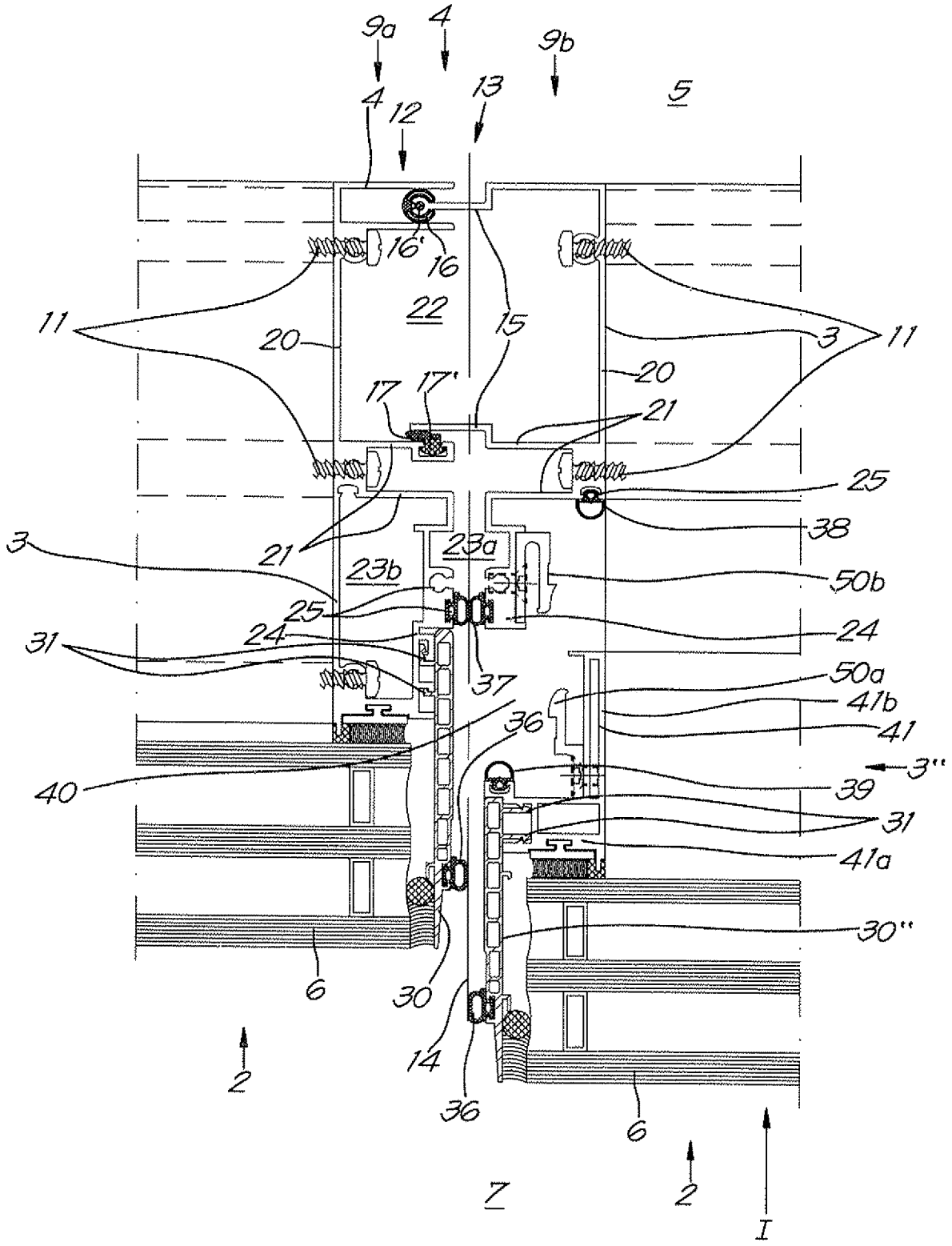
Figure 23:
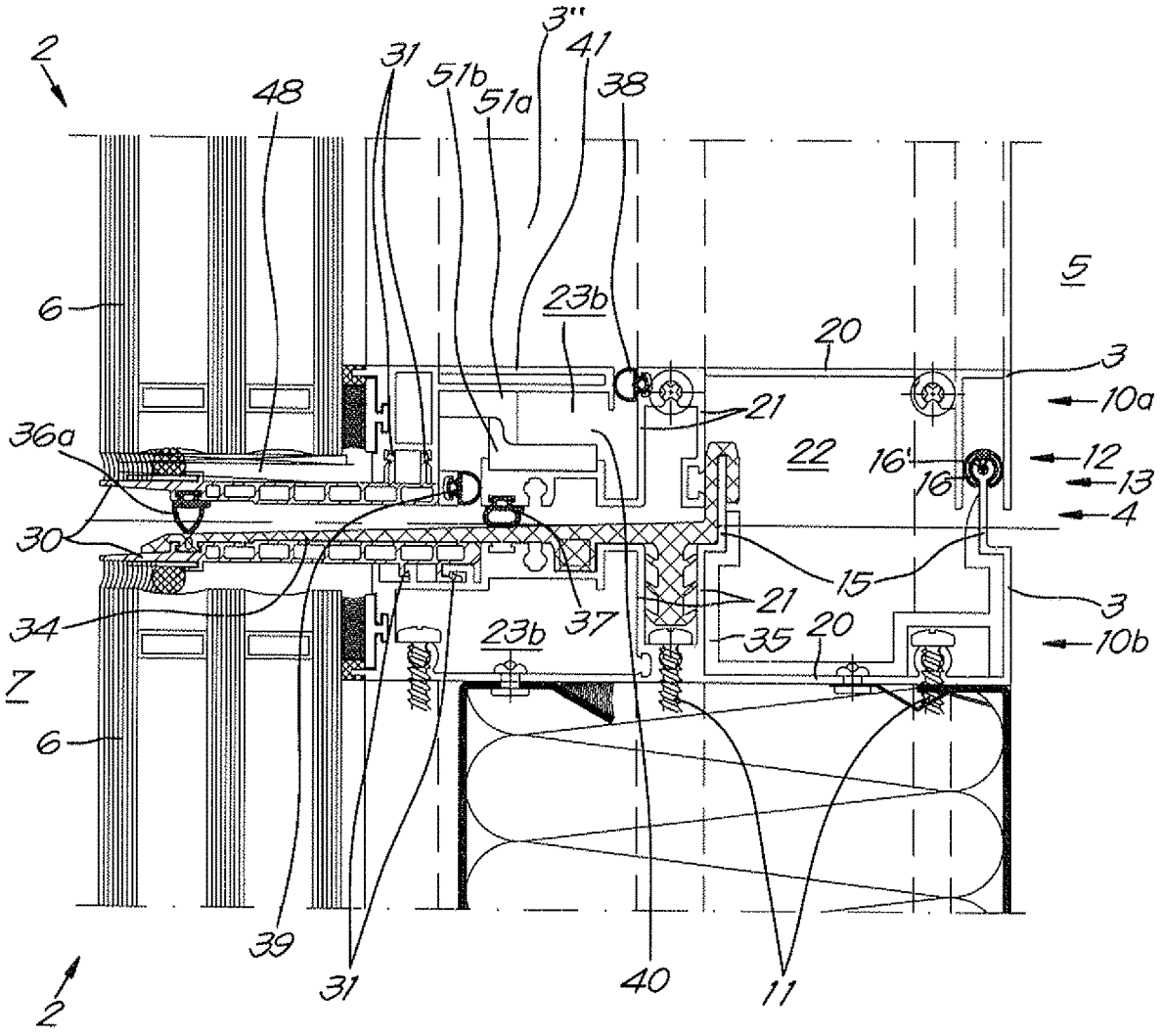
FIGS. 23 and 24 respectively show a cross-section according to the lines XXIII-XXIII and XXIV-XXIV in FIG. 20 but after the replacement of the damaged infill element.
Figure 24:
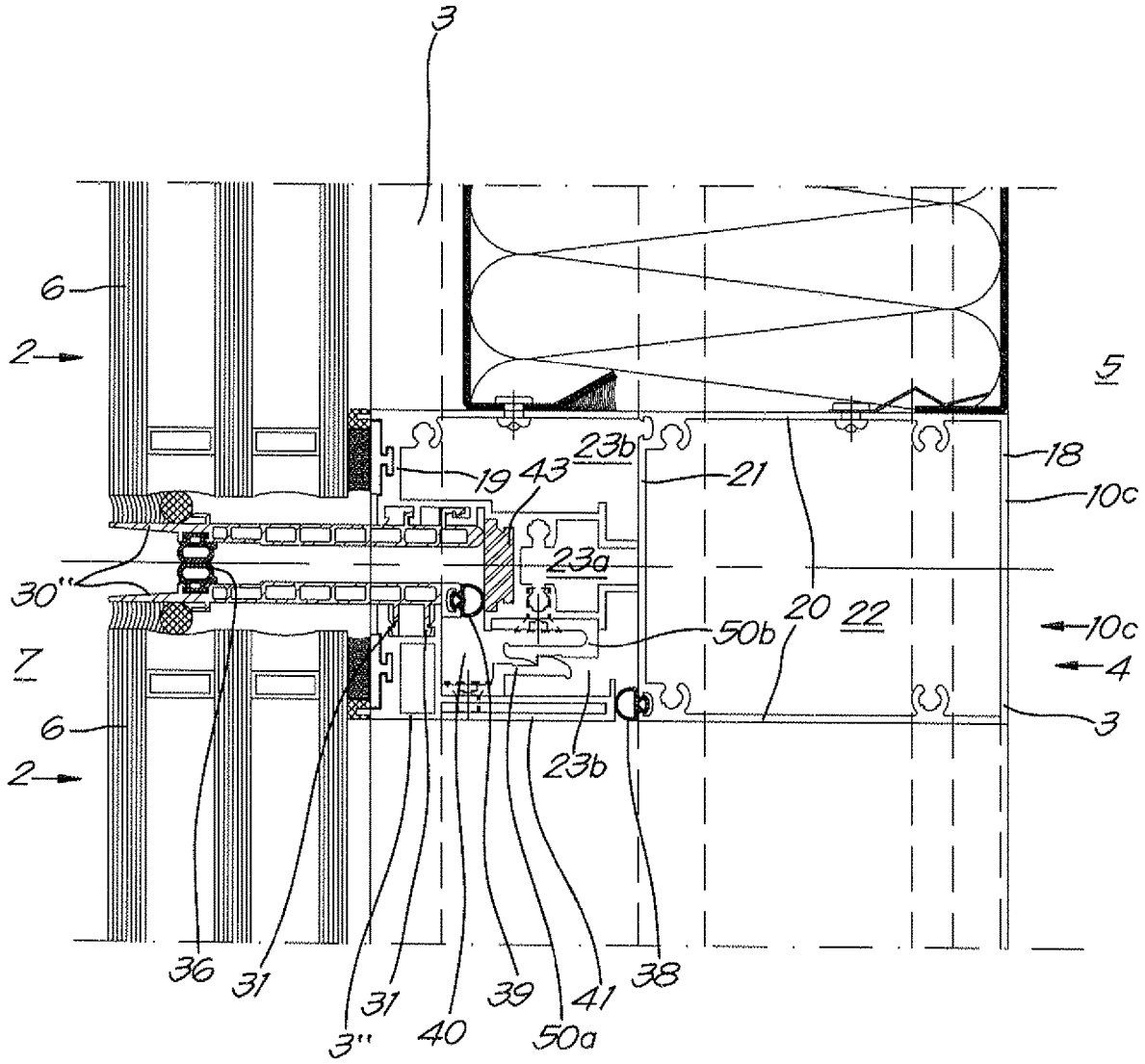

To this end a wing frame 3" with a replacement infill element 6*a* is fabricated beforehand as shown in the FIGS. 22 to 24, similar to the wing frame 3" in FIG. 11 for a wing that opens consisting of L-shaped profiles 41 with the required insulation profiles 30" sealed along the edges of the infill element 6*a* and fitted with seals 36 and 39 all around.

The L-shaped profiles 41 on the leg 41*b* are fitted with a sideways elastic clip connection 50*a* on the vertical profiles 41 as shown in FIG. 22 and on the uppermost profile 41 of the wing frame 3" as shown in FIG. 24 and on the lowest profile 41 of the wing frame 3" a reinforcement lug 51*a* with a downwards-facing lip as shown in FIG. 23.

In order to remove the broken infill element 6*a*, use is first made from the inside of one or several suction cups applied to the inside of the broken infill element in order to hold and manipulate the infill element from the inside. In doing so the suction cups are attached to the inside of the building making it impossible for the infill element for replacement 6*a* to fall down.

Figure 21:
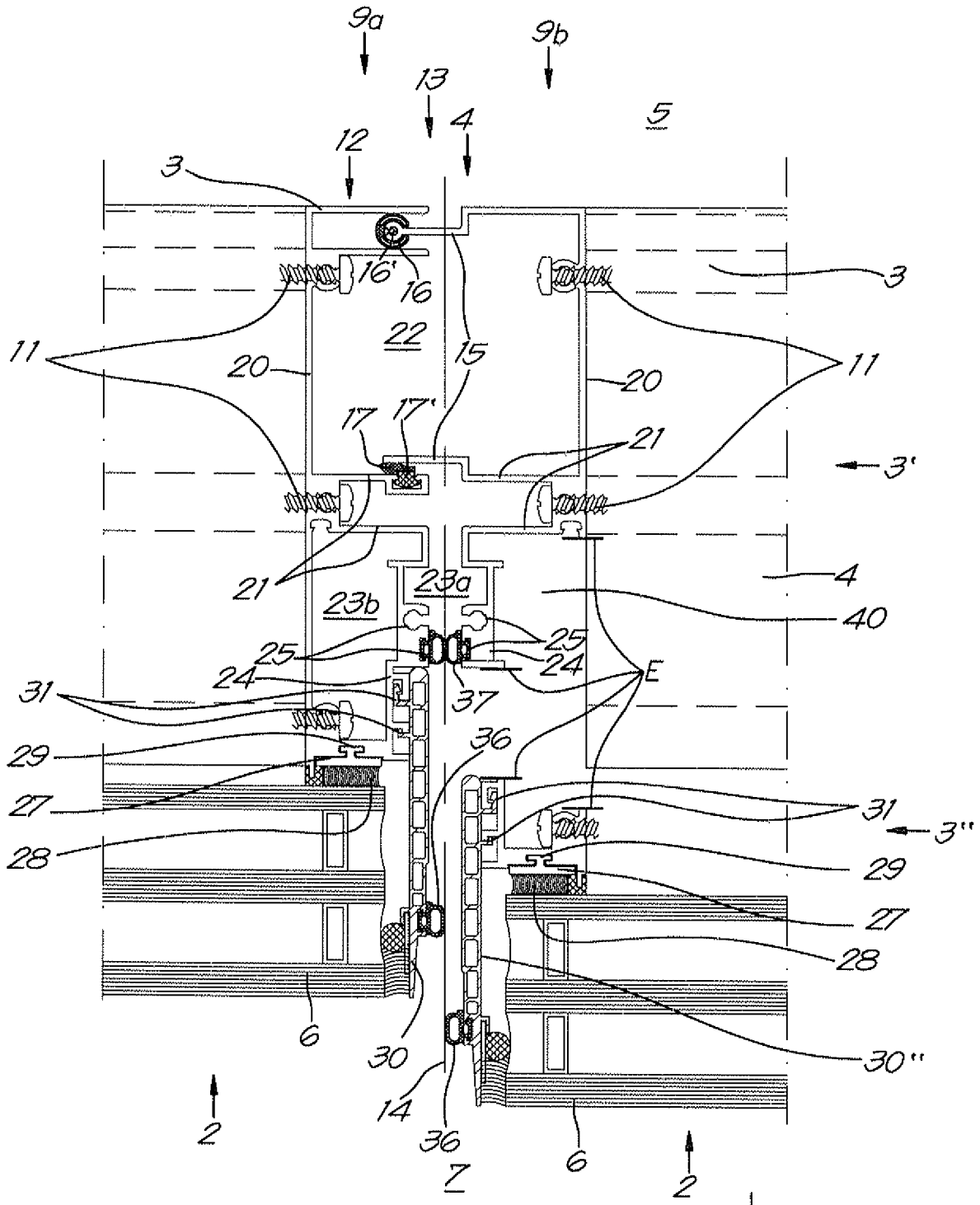
FIGS. 21 and 22 show a cross-section according to the lines XXI-XXI in FIG. 20 during two consecutive steps in the replacement of a cracked or damaged infill element.

Then the basic frame 3 around the broken infill element 6*a* is sawed or cut along the lines E as shown in FIG. 21, whereby the infill element for replacement 6*a* can be removed with a part of the basic frame 3 as shown with arrow O in FIG. 21 and a rebate 40 remains in the remaining part of the basic frame 3.

In the corners of the rebate 40 appropriate corner pieces 44 are applied and one or more, preferably two complementary clip connections 50*b* are attached with screws or the like at the level of the mullions 9 and of the upper transom 10*c* of the compartment 3*a* of the infill element for replacement 6*a* and one or more complementary reinforcement lugs 51*b* on the lower transom 10*a*, each reinforcement lug 51*b* with an upward-facing lip behind which the downward-facing lip of the reinforcement lug 51*a* of the wing with the replacement infill element 2 can be hooked as shown in FIG. 23.

Once the broken infill element 6*a* with the attached cut frame part of the basic frame 3 is removed, a seal 38 is then attached in the remaining detailing 25 on the partition 21 and an insulation slat 43 is attached in the intermediate transom 10*c* as shown in FIG. 24.

All that then needs to be done is to attach the tailor-made prefabricated wing frame 3" with the replacement infill element 6*a* first from the inside in the remaining opening in the curtain wall 1, using the aforementioned suction cups, by turning the wing frame 3" from the inside towards the outside and by placing it with reinforcement lugs 51*a* on its lowest profile 41 on the lowest reinforcement lugs 51*b* in the rebate 40 with the lip of the reinforcement lugs 51*a* hooking behind the lip of the reinforcement lugs 51*b*.

Once the wing frame 3" with replacement infill element is placed horizontally in the correct position, this wing frame 3" resting on the reinforcement lugs 51*a* and 51*b* is tipped inside with a rotating pulling movement around the rotation axis through the contact line between the lugs 51*a* and 51*b* as shown with arrow I in FIG. 22, and clipped tight in the curtain wall 1 by hooking the elastic clip connections 50*a* and 50*b* into each other as shown in the FIGS. 22 and 24.

The reinforcement lugs 51*a* and 51*b* are shaped in such a way that the wing frame 3" slides easily into the correct position in the rebate 40 or the basic frame 3.

Throughout the entire operation the installers are inside the building.

The present invention is in no way limited to the example described and the embodiment shown in the figures of a modular curtain wall according to the invention and wall elements applied therein and corner pieces for sealing, but such curtain wall, wall element and corner piece according to the invention can be realised in all kinds of forms and dimensions without departing from the scope of the invention.

The invention claimed is:

1. A wall element for a curtain wall of the modular frame type, wherein the wall element contains a basic frame that is made of mullions and transoms, said basic frame containing one or more compartments of which at least one compartment is fitted with a rebate to flush-mount an opening wing of a door or a window, wherein the transoms of the at least one compartment for a wing have perpendicular ends and are attached with the perpendicular ends between the mullions, wherein the mullions are made of profiles with an internal chamber contained by an outside wall facing an outside of the curtain wall, a sidewall of the mullion facing the at least one compartment for the wing, a partition wall at a distance from an inside wall of the curtain wall, and a connecting wall between the outside wall and the partition wall, wherein the outside wall and the sidewall of the millions of the at least one compartment have been at least partially locally removed along a height of the at least one compartment to form the rebate for the wing, and wherein in corners of the at least one compartment for the wing, a seal is provided to create a windproof and watertight connection between the mullions and transoms of the at least one compartment, wherein the seal is realized as a corner piece from rubber or another flexible sealing material and that is formed and sized such that at the corners to be sealed it fits in the rebate formed in the mullion and on an end of the transom while overlapping and covering the connection between the mullion and the transom.

2. The wall element of claim 1, wherein the transoms of a compartment for a wing are provided with an appropriate rebate with walls spanning their entire length.

3. The wall element of claim 2, wherein the corner piece in the corners touches the rebate with the walls in the mullions and transoms.

4. The wall element of claim 3, wherein the corner piece in the corners of a compartment for a wing grips over a part of the connecting walls of the mullions of an opened side chamber and over the corresponding walls of the rebate in the transoms.

5. A wall element for a curtain wall of the modular frame type, wherein the wall element contains a basic frame that is made of mullions and transoms, said basic frame containing one or more compartments of which at least one compartment is fitted with a rebate to flush-mount an opening wing of a door or a window, wherein the transoms of such compartment for a wing have perpendicular ends and are attached with the perpendicular ends between the mullions, wherein the mullions are made of profiles with an internal chamber contained by an outside wall facing an outside of the curtain wall, a sidewall of the mullion facing the at least one compartment for the wing, a partition wall at a distance from an inside wall of the curtain wall, and a connecting wall between the outside wall and the partition wall, wherein the outside wall and the sidewall of the millions of the at least one compartment have been at least partially locally removed along a height of the at least one compartment to form the rebate for the wing, and wherein in corners of the at least one compartment for the wing, a seal is provided to create a windproof and watertight connection between the mullions and transoms of the at least one compartment, wherein the seal is realized as a corner piece from rubber or flexible sealing material and that is formed and sized such that at the corners to be sealed it fits in the rebate formed in the mullion and on an end of the transom while overlapping and covering the connection between the mullion and the transom, wherein the transoms of a compartment for a wing are provided with an appropriate rebate with walls spanning their entire length, wherein the corner piece in the corners touches the walls of the rebate in the mullions and transoms, wherein the corner piece in the corners of a compartment for a wing grips over a part of the connecting walls of the mullions of the opened side chamber and over the corresponding walls of the rebate in the transoms, and wherein the corner piece has a U-shaped profiled body with a back and legs with which the corner piece grips over the connecting wall of the rebate of a transom.

6. The wall element of claim 5, wherein a side edge of the corner piece has a U-shaped finish wherein the aforementioned legs of the corner piece are extended with a part that sticks out vis-a-vis the edge of a back of the corner piece and wherein the corner piece grips over the remaining part of the connecting wall of the opened side chamber of an adjacent mullion with these extended parts.

7. The wall element of claim 5, wherein at least one of the transoms with a rebate is an intermediate transom between a compartment with a fixed infill element and a compartment with a wing, wherein this intermediate transom is fitted with a closed internal side chamber on a side of the compartment with the fixed infill element and a rebate on another side of the compartment with the wing and wherein the corner pieces for this intermediate transom along a free edge of one leg are fitted with a lip that touches a connecting wall of a closed internal chamber and is fitted with an extended part that extends to seal up to the rebate of the connecting mullion profile.

8. The wall element of claim 5, wherein at the connecting wall overlying detailing has been fitted which at the corners of a compartment with a wing has been partially removed on the transoms over a certain length so that when tightening the transom against a mullion, the corner piece is clamped between a remaining part of the overlying detailing and the adjacent mullion.

9. The wall element of claim 1, wherein the corner piece is glued in the rebate.

10. The wall element of claim 1, wherein the corner piece has been sealed in the rebate without the use of silicones or sealing material.

11. The wall element of claim 1, wherein the corner piece forms a sealing without pressure having to be exercised in a direction perpendicular to a plane parallel to the curtain wall.

12. A curtain wall, wherein the curtin wall is modular with wall elements mounted in rows next to and above each other along the perimeter consist of mullions and transoms which are fitted with female and male coupling parts with which adjacent wall elements fit above each other and next to each other and wherein at least one wall element is a wall element according to claim 1 with the compartment for a wing that is sealed in the corners with an aforementioned corner piece.

13. The wall element of claim 2, wherein the corner piece has a U-shaped profiled body with a back and legs with which the corner piece grips against a wall of the rebate of the transom.

* * * * *